US012391889B2

(12) United States Patent
Lange et al.

(10) Patent No.: US 12,391,889 B2
(45) **Date of Patent: *Aug. 19, 2025**

(54) RECOVERY OF ALIPHATIC HYDROCARBONS

(71) Applicant: SHELL OIL COMPANY

(72) Inventors: Jean-Paul Andre Marie Joseph Ghislain Lange, Amsterdam (NL); Kai Jürgen Fischer, Amsterdam (NL); Guus Van Rossum, Amsterdam (NL); Timothé Johannes Olthof, Amsterdam (NL); Sybe Sipma, Amsterdam (NL); Luis Alberto Grau Lisnier, Amsterdam (NL); Hendrik Stichter, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/247,103

(22) PCT Filed: Oct. 12, 2021

(86) PCT No.: PCT/EP2021/078172

§ 371 (c)(1),
(2) Date: Mar. 29, 2023

(87) PCT Pub. No.: WO2022/079025

PCT Pub. Date: Apr. 21, 2022

(65) Prior Publication Data

US 2023/0374400 A1 Nov. 23, 2023

(30) Foreign Application Priority Data

Oct. 16, 2020 (EP) ..... 20202268

(51) Int. Cl.
*C10G 53/06* (2006.01)
*C10G 1/00* (2006.01)
*C10G 55/04* (2006.01)

(52) U.S. Cl.
CPC ..... *C10G 53/06* (2013.01); *C10G 1/002* (2013.01); *C10G 55/04* (2013.01); *C10G 2300/202* (2013.01); *C10G 2300/4081* (2013.01)

(58) Field of Classification Search
CPC ..... C10G 1/002; C10G 53/06; C10G 55/04
See application file for complete search history.

(56) References Cited

U.S. PATENT DOCUMENTS 3,451,925 A 6/1969 Morris et al.
9,856,425 B2 1/2018 Ward et al.
(Continued)

FOREIGN PATENT DOCUMENTS

WO 2005040308 A2 5/2005

OTHER PUBLICATIONS

International Search Report and Written Opinion Received for PCT Patent Application No. PCT/EP2021/078172, Mailed on Nov. 3, 2021, 11 Pages.

(Continued)

*Primary Examiner* — Renee Robinson
(74) *Attorney, Agent, or Firm* — SHELL USA, INC.

(57) ABSTRACT

The invention relates to a process for the recovery of aliphatic hydrocarbons from a liquid stream comprising aliphatic hydrocarbons, heteroatom containing organic compounds and optionally aromatic hydrocarbons, involving (i) contacting said liquid stream with a washing solvent thereby removing heteroatom containing organic compounds; a) liquid-liquid extraction of the washed stream with an extraction solvent thereby recovering part of the aliphatic hydro- (Continued)

carbons; b1) mixing the extract stream, comprising extraction solvent, aliphatic hydrocarbons, heteroatom containing organic compounds and optionally aromatic hydrocarbons, with a demixing solvent to recover additional aliphatic hydrocarbons; b2) mixing the remaining stream with additional demixing solvent to remove heteroatom containing organic compounds and optional aromatic hydrocarbons; and c) separation of the remaining stream into a demixing solvent stream and an extraction solvent stream. Further, the invention relates to a process for the recovery of aliphatic hydrocarbons from plastics comprising the above-mentioned process; and to a process for steam cracking a hydrocarbon feed comprising aliphatic hydrocarbons as recovered in one of the above-mentioned processes.

12 Claims, 2 Drawing Sheets

(56) References Cited

U.S. PATENT DOCUMENTS

| | | | |
|---|---|---|---|
| 11,959,026 | B2 | 4/2024 | Zhang et al. |
| 2009/0200208 | A1 | 8/2009 | Farkas |
| 2015/0210934 | A1 | 7/2015 | Khandelwal et al. |
| 2018/0187087 | A1 | 7/2018 | Atkins et al. |
| 2018/0355256 | A1 | 12/2018 | Dooley |
| 2019/0177626 | A1 | 6/2019 | Ramamurthy et al. |

OTHER PUBLICATIONS

Venkatram et al., "Critical Assessment of the Hildebrand and Hansen Solubility Parameters for Polymers", Journal of Chemical Information and Modeling, Sep. 23, 2019, vol. 59, Issue No. 10, pp. 4188-4194.

Dearmitt, "26—Functional Fillers for Plastics", Applied Plastics Engineering Handbook, 2011, pp. 455-468.

International Search Report and Written Opinion Received for PCT Patent Application No. PCT/EP2021/078221, Mailed on Jan. 13, 2022, 13 Pages.

International Search Report and Written Opinion Received for PCT Patent Application No. PCT/EP2021/078153, Mailed on Oct. 28, 2021, 11 Pages.

Office Action Received for Chinese Application No. 202180070044.X, Mailed on Dec. 20, 2024, 23 Pages(15 Pages of English Translation and 08 Pages of Official Copy).

RECOVERY OF ALIPHATIC HYDROCARBONS

CROSS REFERENCE TO RELATED APPLICATIONS

This is a National stage application of International Application No. PCT/EP2021/078172, filed 12 Oct. 2021, which claims priority of European Procedure application No. 20202268.7, filed 16 Oct. 2020 which are incorporated herein by reference in their entirety.

FIELD OF THE INVENTION

The present invention relates to a process for the recovery of aliphatic hydrocarbons from a liquid hydrocarbon feedstock stream comprising aliphatic hydrocarbons, heteroatom containing organic compounds and optionally aromatic hydrocarbons; to a process for the recovery of aliphatic hydrocarbons from plastics comprising the above-mentioned process; and to a process for steam cracking a hydrocarbon feed comprising aliphatic hydrocarbons as recovered in one of the above-mentioned processes.

BACKGROUND OF THE INVENTION

Waste plastics can be converted via cracking of the plastics, for example by pyrolysis, to high-value chemicals, including olefins and aromatic hydrocarbons. Pyrolysis of plastics can yield product streams containing hydrocarbons in a wide boiling range. Hydrocarbons from such pyrolysis product streams can be further cracked in a steam cracker to produce high-value chemicals, including ethylene and propylene which are monomers that can be used in making new plastics.

WO2018069794 discloses a process for producing olefins and aromatic hydrocarbons from plastics wherein a liquid pyrolysis product stream is separated into a first fraction having a boiling point <300° C. and a second fraction having a boiling point ≥300° C. Only said first fraction is fed to a liquid steam cracker, whereas said second fraction is recycled to the pyrolysis unit. In the process shown in FIG. 1 of WO2018069794, said separation is performed in a hydrocarbon liquid distillation unit. Having to separate the liquid pyrolysis product stream into two fractions is cumbersome (e.g. energy intensive). A further disadvantage is that the heavier portion of the liquid pyrolysis product stream has to be sent back to the pyrolysis unit for a deeper pyrolysis. This results in yield loss through the formation of gas and an increasing amount of solid side-product (coke) which is eventually not sent to the steam cracker. In one embodiment of the process of above-mentioned WO2018069794 (see FIG. 2), the first fraction having a boiling point <300° C. is first conveyed together with hydrogen to a hydroprocessing unit to produce a treated hydrocarbon liquid stream which is then fed to the liquid steam cracker. Such hydroprocessing is also cumbersome, as it is capital intensive and requires the use of expensive hydrogen ($H_2$).

Further, US20180355256 discloses a method for deriving fuel from plastics, the method comprising subjecting a quantity of plastics to a pyrolytic process, thereby to convert at least part of the plastics to a crude fuel; and extracting the fuel in a directly usable form by way of: 1) a first extraction step comprising counterflow liquid-liquid extraction using one or more extraction solvents to extract one or more impurities from the crude fuel; and 2) a second extraction step comprising counterflow extraction of resultant contaminated extraction solvent(s) from the first extraction step. In the process as shown in FIG. 2 of US20180355256, a crude fuel (i.e. a crude diesel) that is made by pyrolysis of plastics, is first subjected to extraction with N-methyl-2-pyrrolidone (NMP) to extract one or more impurities, including sulfur compounds and aromatics, from the crude fuel. The contaminated NMP from the first extraction step is then subjected to a second extraction step using water, to increase the polarity of the contaminated extraction solvent, thereby separating off said impurities. In a final step, the water-contaminated NMP from the second extraction step is distilled using a standard distillation column, which gives rise to recycle water and recycle NMP.

The effluent from the extraction column used in the first extraction step as disclosed in above-mentioned US20180355256 (FIG. 2) may still comprise a certain amount of valuable aliphatic hydrocarbons, in addition to heteroatom containing organic contaminants and aromatic contaminants. It is desired to recover as much aliphatic hydrocarbons as possible, and hence to separate these from the heteroatom containing organic contaminants and aromatic contaminants. Upon such recovery, these additional aliphatic hydrocarbons could then either be recycled to the first extraction step or be combined directly with the raffinate stream (purified diesel) from the first extraction step, so as to optimize the total recovery of aliphatic hydrocarbons. Such additional aliphatic hydrocarbons to be recovered may also be fed to a steam cracker, instead of being used as a fuel as disclosed in US20180355256. However, such recovery of additional aliphatic hydrocarbons may be complicated by the step(s) following the first extraction step, resulting in one or more effluent stream(s) comprising aliphatic hydrocarbons which still additionally comprise a too large amount of heteroatom containing organic contaminants and aromatic contaminants so that these effluent stream(s) cannot be recycled or combined as described above.

In addition, the feed to the distillation column as disclosed in above-mentioned US20180355256 (FIG. 2) may still comprise a certain amount of heteroatom containing organic contaminants, especially oxygen containing organic contaminants, in particular the more polar components including e.g. phenol. Said distillation may result in that part of said contaminants is separated off together with the recycle water because water and such contaminants may form an azeotrope, thereby reducing the quality of the water recycle stream. In case that recycle water is recycled to the column used in the second extraction step, the concentration of these contaminants in the recycle water will increase in what is denominated "build-up", in addition to a build-up of these contaminants in the recycle NMP to be used in the first extraction step. This can result in a lower efficiency of the first and second extraction steps. US20180355256 concerns a method for deriving fuel from plastics. Such build-up of these contaminants (in said recycle NMP) may result in that the cleaned oil still comprises a relatively high amount of these contaminants, which is of particular concern when such cleaned oil would be fed to a steam cracker, instead of being used as a fuel, because of the negative impact of these contaminants on the yield, selectivity and reliability of steam crackers.

Furthermore, in practice, the feedstock may comprise salts, especially a liquid hydrocarbon feedstock stream obtained from pyrolysis of plastics. For example, such feedstock may contain calcite ($CaCO_3$) and wollastonite ($CaSiO_3$) which are known for their use as a filler material in plastics, improving the mechanical properties of plastics.

Such salts may end up in an extract stream, for example in a case wherein the extraction solvent is NMP as used in column A of the process of FIG. 2 of US20180355256. Subsequently, such salts would end up in the water-NMP bottom stream from column B used in said process, and then enter distillation column C where they will concentrate in the NMP bottom stream. The salts will then be recycled together with the NMP and their concentration will build up over time. Furthermore, since NMP and other organic solvents have a limited solvency for salts, they will start precipitating in the distillation column resulting in fouling of the column.

Still further, in practice, the feedstock may comprise other contaminants which should preferably not end up in the raffinate stream resulting from a first extraction step. The feedstock may contain silicon containing compounds, such as silica and siloxane compounds. For example, said silica is known for its use as a filler material, for example glass fiber ($SiO_2$), improving the mechanical properties of plastics. Further, said siloxane compounds may originate from polysiloxane polymers which contain —$R_2Si$—O—$SiR_2$— chains. Such silicon containing compounds from a raffinate stream also have a negative impact when present in the feed to a steam cracker because of the fouling of tube furnaces they may cause in a steam cracker furnace.

There is an ongoing need to develop improved processes for the recovery of aliphatic hydrocarbons from liquid streams comprising aliphatic hydrocarbons, heteroatom containing organic compounds and optionally aromatic hydrocarbons which may originate from cracking waste plastics, in specific mixed waste plastics, especially before feeding such recovered aliphatic hydrocarbons to a steam cracker. It is an object of the present invention to provide such process for the recovery of aliphatic hydrocarbons from such liquid streams, which process is technically advantageous, efficient and affordable, in particular a process which does not have one or more of the above-mentioned disadvantages, as discussed above in connection with WO2018069794 and US20180355256. Such technically advantageous process would preferably result in a relatively low energy demand and/or relatively low capital expenditure.

SUMMARY OF THE INVENTION

Surprisingly it was found by the present inventors that such process can be provided by (i) contacting a liquid stream which comprises aliphatic hydrocarbons, heteroatom containing organic compounds and optionally aromatic hydrocarbons, with a washing solvent d) which contains one or more heteroatoms thereby removing heteroatom containing organic compounds; a) liquid-liquid extraction of a stream resulting from washing step (i) which comprises aliphatic hydrocarbons, heteroatom containing organic compounds and optionally aromatic hydrocarbons, with an extraction solvent a) which contains one or more heteroatoms, thereby recovering part of the aliphatic hydrocarbons; b1) mixing a stream resulting from step a), which comprises extraction solvent a), aliphatic hydrocarbons, heteroatom containing organic compounds and optionally aromatic hydrocarbons, with a demixing solvent b) to recover additional aliphatic hydrocarbons from said stream, wherein demixing solvent b) contains one or more heteroatoms and has a miscibility in heptane which is lower than the miscibility of extraction solvent a) in heptane; b2) mixing a stream resulting from step b1), which comprises extraction solvent a), demixing solvent b), heteroatom containing organic compounds and optionally aromatic hydrocarbons, with additional demixing solvent b) to remove heteroatom containing organic compounds and optional aromatic hydrocarbons; and c) separation of at least part of a stream resulting from step b2), which comprises extraction solvent a) and demixing solvent b) into a demixing solvent b) containing stream and an extraction solvent a) containing stream.

Accordingly, the present invention relates to a process for the recovery of aliphatic hydrocarbons from a liquid hydrocarbon feedstock stream comprising aliphatic hydrocarbons, heteroatom containing organic compounds and optionally aromatic hydrocarbons, said process comprising the steps of:

a) contacting at least part of the liquid hydrocarbon feedstock stream with an extraction solvent a) which contains one or more heteroatoms, and subjecting the liquid hydrocarbon feedstock stream to liquid-liquid extraction with the extraction solvent a), resulting in a first stream comprising aliphatic hydrocarbons and a second stream comprising extraction solvent a), aliphatic hydrocarbons, heteroatom containing organic compounds and optionally aromatic hydrocarbons;

b1) mixing at least part of the second stream resulting from step a) with a demixing solvent b) which contains one or more heteroatoms and has a miscibility in heptane which is lower than the miscibility of extraction solvent a) in heptane, and separating the resulting mixture into a first stream comprising aliphatic hydrocarbons and optionally aromatic hydrocarbons and a second stream comprising extraction solvent a), demixing solvent b), heteroatom containing organic compounds and optionally aromatic hydrocarbons;

b2) mixing at least part of the second stream resulting from step b1) with demixing solvent b) and separating the resulting mixture into a first stream comprising heteroatom containing organic compounds and optionally aromatic hydrocarbons and a second stream comprising extraction solvent a) and demixing solvent b);

wherein steps b1) and b2) are sub-steps of a step b) which comprises two or more sub-steps;

c) separating at least part of the second stream resulting from step b2) into a first stream comprising demixing solvent b) and a second stream comprising extraction solvent a);

d) recycling at least part of the extraction solvent a) from the second stream resulting from step c) to step a); and e) optionally recycling at least part of the demixing solvent b) from the first stream resulting from step c) to one or more of the sub-steps of step b), wherein:

(i) before step a), heteroatom containing organic compounds are removed from the liquid hydrocarbon feedstock stream by contacting at least part of that stream with a washing solvent d) which contains one or more heteroatoms.

Advantageously, in the present invention, there is no need for hydrotreating (treatment with $H_2$) because of said liquid-liquid extraction in step a). Furthermore, advantageously, a liquid hydrocarbon stream having a wide boiling range, such as plastics pyrolysis oil, may be treated in the present process with a relatively low yield loss and feed degradation. This implies that the costs of a hydrocarbon feed to a steam cracker may be reduced considerably by applying the present invention.

Further, because in step b) of the process of the present invention demixing solvent b) is mixed with the extract stream resulting from step a), which still comprises a certain amount of valuable aliphatic hydrocarbons, in a staged fashion (stepwise or incrementally) rather than adding the total amount of such demixing solvent b) in one step only, in a first sub-step b1) a stream comprising aliphatic hydrocarbons and optionally aromatic hydrocarbons (first stream) is advantageously recovered, whereas the remaining stream comprising extraction solvent a), demixing solvent b), heteroatom containing organic compounds and optionally aromatic hydrocarbons (second stream) is subsequently mixed in a further sub-step b2) with another portion of the demixing solvent b) thereby advantageously resulting in a more efficient removal of heteroatom containing organic compounds and optionally aromatic hydrocarbons (in first stream), leaving a stream comprising extraction solvent a) and demixing solvent b) (second stream) which in step c) are then separated from each other. Thus, in each sub-step b1), b2) and any further sub-step in step b), the composition of the stream (first stream) separated from the stream comprising extraction solvent a) and demixing solvent b) (second stream) and containing compounds to be recovered or removed (i.e. separated) is different, as further described below. This advantageously enables a fractionated separation of the components extracted in step a) into a number of different fractions, which number depends on the number of sub-steps in step b), each of which fractions may have a different value and end use.

Still further, advantageously, part of the heteroatom containing organic compounds, especially oxygen containing organic contaminants, in particular the more polar components including e.g. phenol, are removed in step (i) preceding extraction step a), in which step (i) at least part of the liquid hydrocarbon feedstock stream is contacted with washing solvent d), thereby avoiding or reducing a build-up of such contaminants in the downstream part of the present process. Furthermore, advantageously, in said washing step (i) any salts from the feedstock stream are also removed, thereby preventing a build-up of such salts to higher concentrations in the downstream section, and thereby at the same time preventing fouling of a downstream distillation column by precipitation of such salts.

Further, because in the present invention both (i) the efficiency of overall separation step b), comprising sub-steps b1) and b2), is increased, and (ii) heteroatom containing organic compounds are not only removed in said step b) but also in washing step (i) preceding extraction step a), advantageously, substantially no or a reduced amount of heteroatom containing organic compounds and any aromatic hydrocarbons may eventually partition into the stream comprising extraction solvent a) and demixing solvent b) resulting from overall step b) of the present process. Said heteroatom containing organic compounds and aromatic compounds may comprise the components with the highest polarity of all the heteroatom containing organic compounds and aromatic compounds as extracted in step a) of the present process. Thus, advantageously, by overall step b) and washing step (i) in the process of the present invention, relatively pure demixing solvent b) recycle and relatively pure extraction solvent a) recycle streams, that are substantially free of heteroatom containing organic compounds and aromatic hydrocarbons originating from the liquid hydrocarbon feedstock stream, or that contain these contaminants in a reduced amount, can be delivered in step c) of the present process. In turn, such pure demixing solvent b) stream can then advantageously be recycled and used to extract extraction solvent a), either in step a) itself or in another additional step, thereby preventing extraction solvent a) from entering the final hydrocarbon raffinate stream, without contaminating such raffinate stream with heteroatom containing organic compounds and aromatic hydrocarbons. With respect to the latter use of demixing solvent b) upon recycle, that solvent is hereinbelow also referred to as washing solvent c). Likewise, such pure extraction solvent a) stream from step c) can then advantageously be recycled to step a) and used to extract further heteroatom containing organic compounds and optional aromatic hydrocarbons from fresh feed.

Thus, advantageously, a build-up of the heteroatom containing organic compounds and any salts in the recycle stream(s) in the present process may be prevented or reduced as a consequence of overall separation step b), comprising sub-steps b1) and b2), which involves a staged addition of demixing solvent b), and washing step (i) preceding extraction step a) which involves addition of washing solvent d). Because of that, there is no need or a substantially reduced need to apply other, cumbersome methods for mitigating a build-up of these contaminants. For example, there is no need or a substantially reduced need to bleed part of the recycle streams before recycling, wherein either (i) such bleed stream is discarded resulting in a loss of extraction solvent a) or (ii) extraction solvent a) may be recovered from such bleed stream, for example by distillation thereof, which is however cumbersome.

In addition, in the above-described washing step (i) in the process of the present invention, other contaminants which should preferably not end up in the raffinate stream resulting from extraction step a), may advantageously also be removed simultaneously with the above-mentioned heteroatom containing organic contaminants and optional salts. For example, the above-mentioned silicon containing compounds, such as silica and siloxane compounds, may advantageously also be removed in step (i) of the present process, thereby preventing any negative impact that such contaminants may have in a subsequent process, such as a steam cracking process.

Further, the present invention relates to a process for the recovery of aliphatic hydrocarbons from plastics, wherein at least part of the plastics comprises heteroatom containing organic compounds, said process comprising the steps of:

(I) cracking the plastics and recovering a hydrocarbon product comprising aliphatic hydrocarbons, heteroatom containing organic compounds and optionally aromatic hydrocarbons; and (II) subjecting a liquid hydrocarbon feedstock stream, which comprises at least part of the hydrocarbon product obtained in step (I), to the above-mentioned process for the recovery of aliphatic hydrocarbons from a liquid hydrocarbon feedstock stream.

Still further, the present invention relates to a process for steam cracking a hydrocarbon feed, wherein the hydrocarbon feed comprises aliphatic hydrocarbons as recovered in one of the above-mentioned processes for the recovery of aliphatic hydrocarbons.

DETAILED DESCRIPTION OF THE INVENTION

Figure 1:
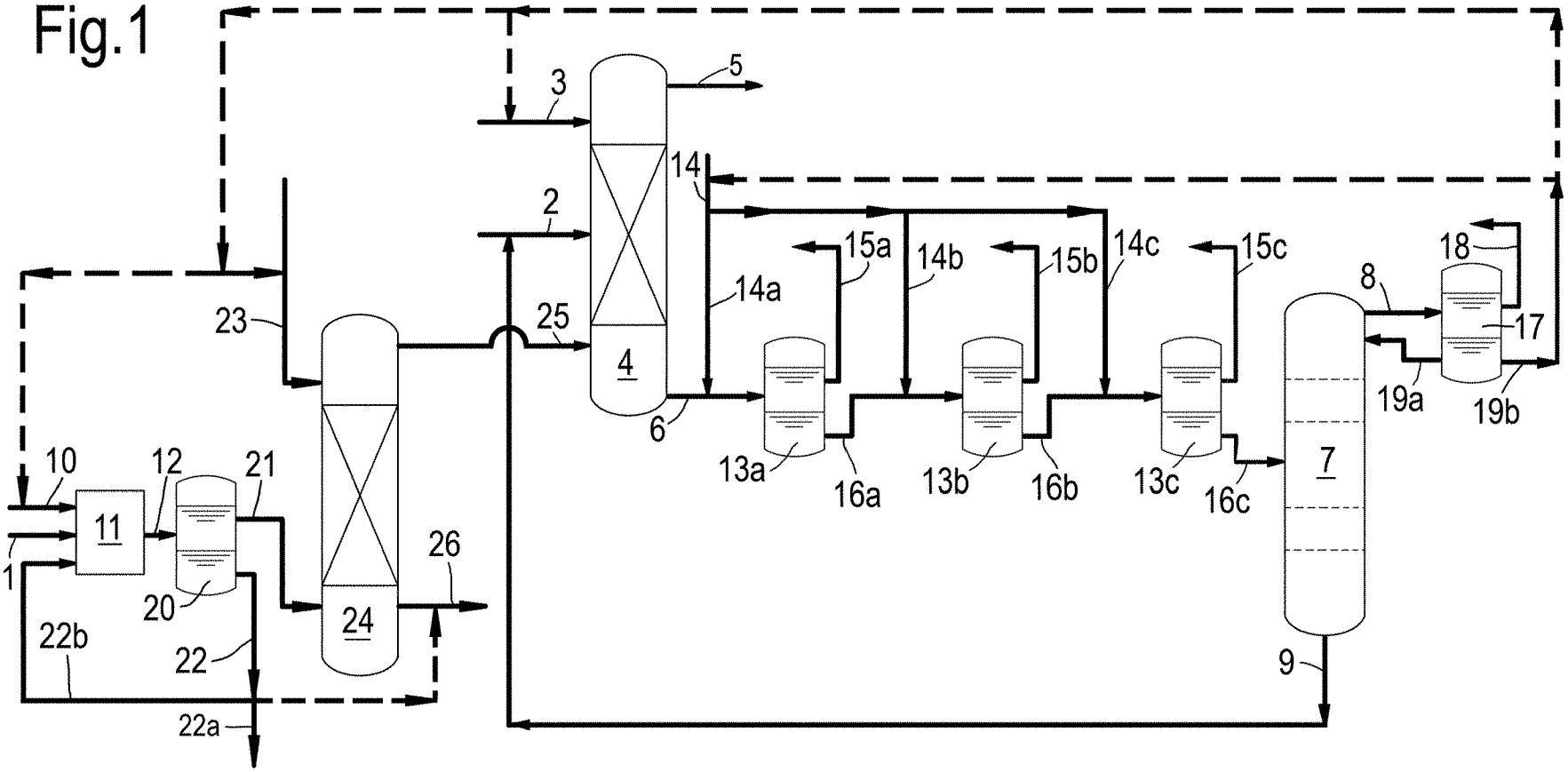
FIG. 1 shows one embodiment of the process for the recovery of aliphatic hydrocarbons in accordance with the present invention.

Each of the processes of the present invention comprises multiple steps. In addition, said process may comprise one or more intermediate steps between consecutive steps. Further, said process may comprise one or more additional steps preceding the first step and/or following the last step. For example, in a case where said process comprises steps a), b) and c), said process may comprise one or more intermediate steps between steps a) and b) and between steps b) and c). Further, said process may comprise one or more additional steps preceding step a) and/or following step c).

Within the present specification, a phrase like "step y) comprises subjecting at least part of the stream resulting from step x) to" means "step y) comprises subjecting part or all of the stream resulting from step x) to" or, similarly, "step y) comprises partially or completely subjecting the stream resulting from step x) to". For example, the stream resulting from step x) may be split into one or more parts wherein at least one of these parts may be subjected to step y). Further, for example, the stream resulting from step x) may be subjected to an intermediate step between steps x) and y) resulting in a further stream at least part of which may be subjected to step y).

While the process(es) of the present invention and the stream(s) and composition(s) used in said process(es) are described in terms of "comprising", "containing" or "including" one or more various described steps and components, respectively, they can also "consist essentially of" or "consist of" said one or more various described steps and components, respectively.".

In the context of the present invention, in a case where a stream comprises two or more components, these components are to be selected in an overall amount not to exceed 100%.

Further, where upper and lower limits are quoted for a property then a range of values defined by a combination of any of the upper limits with any of the lower limits is also implied.

Within the present specification, by "substantially no" in relation to the amount of a specific component in a stream, it is meant an amount which is at most 1,000, preferably at most 500, more preferably at most 100, more preferably at most 50, more preferably at most 30, more preferably at most 20, and most preferably at most 10 ppmw (parts per million by weight) of the component in question, based on the amount (i.e. weight) of said stream.

Within the present specification, by "top stream" or "bottom stream" from a column reference is made to a stream which exits the column at a position, which is between 0% and 30%, more suitably between 0% and 20%, even more suitably between 0% and 10%, based on the total column length, from the top of the column or the bottom of the column, respectively.

Unless indicated otherwise, where in the present specification reference is made to a boiling point this means the boiling point at 760 mm Hg pressure (101.3 kPa).

Within the present specification, the term "heteroatom containing compounds" refers to heteroatom containing organic compounds and/or heteroatom containing inorganic compounds including salts.

Liquid Hydrocarbon Feedstock Stream

In the present invention, the liquid hydrocarbon feedstock stream comprises aliphatic hydrocarbons, heteroatom containing organic compounds and optionally aromatic hydrocarbons.

Preferably, the liquid hydrocarbon feedstock stream comprises both aliphatic hydrocarbons having a boiling point of from 30 to 300° C. and aliphatic hydrocarbons having a boiling point of from greater than 300 to 600° C. in a weight ratio of from 99:1 to 1:99. The amount of aliphatic hydrocarbons having a boiling point of from 30 to 300° C., based on the total amount of aliphatic hydrocarbons having a boiling point of from 30 to 600° C., may be at most 99 wt. % or at most 80 wt. % or at most 60 wt. % or at most 40 wt. % or at most 30 wt. % or at most 20 wt. % or at most 10 wt. %. Further, the amount of aliphatic hydrocarbons having a boiling point of from 30 to 300° C., based on the total amount of aliphatic hydrocarbons having a boiling point of from 30 to 600° C., may be at least 1 wt. % or at least 5 wt. % or at least 10 wt. % or at least 20 wt. % or at least 30 wt. %.

Thus, advantageously, the liquid hydrocarbon feedstock stream may comprise varying amounts of aliphatic hydrocarbons within a wide boiling point range of from 30 to 600° C. Accordingly, as with the boiling point, the carbon number of the aliphatic hydrocarbons in the liquid hydrocarbon feedstock stream may also vary within a wide range, for example of from 5 to 50 carbon atoms. The carbon number of the aliphatic hydrocarbons in the liquid hydrocarbon feedstock stream may be at least 4 or at least 5 or at least 6 and may be at most 50 or at most 40 or at most 30 or at most 20.

The amount of aliphatic hydrocarbons in the liquid hydrocarbon feedstock stream, based on the total weight of the liquid hydrocarbon feedstock stream, may be at least 30 wt. % or at least 50 wt. % or at least 80 wt. % or at least 90 wt. % or at least 95 wt. % or at least 99 wt. % and may be smaller than 100 wt. % or at most 99 wt. % or at most 90 wt. % or at most 80 wt. % or at most 70 wt. %. The aliphatic hydrocarbons may be cyclic, linear and branched.

The aliphatic hydrocarbons in the liquid hydrocarbon feedstock stream may comprise non-olefinic (paraffinic) and olefinic aliphatic compounds. The amount of paraffinic aliphatic compounds in the liquid hydrocarbon feedstock stream, based on the total weight of the liquid hydrocarbon feedstock stream, may be at least 20 wt. % or at least 40 wt. % or at least 60 wt. % or at least 80 wt. % and may be smaller than 100 wt. % or at most 99 wt. % or at most 80 wt. % or at most 60 wt. %. Further, the amount of olefinic aliphatic compounds in the liquid hydrocarbon feedstock stream, based on the total weight of the liquid hydrocarbon feedstock stream, may be smaller than 100 wt. % or at least 20 wt. % or at least 40 wt. % or at least 60 wt. % or at least 80 wt. % and may be at most 99 wt. % or at most 80 wt. % or at most 60 wt. %.

Further, the olefinic compounds may comprise aliphatic compounds having one carbon-carbon double bond (mono-olefins) and/or aliphatic compounds having two or more carbon-carbon double bonds which latter compounds may be conjugated or non-conjugated. That is to say, the two or more carbon-carbon double bonds may be conjugated or not conjugated. The aliphatic compounds having two or more carbon-carbon double bonds may include compounds having double bonds at alpha and omega positions. The amount of mono-olefins in the liquid hydrocarbon feedstock stream, based on the total weight of the liquid hydrocarbon feedstock stream, may be at least 20 wt. % or at least 40 wt. % or at least 60 wt. % or at least 80 wt. % and may be smaller than 100 wt. % or at most 99 wt. % or at most 80 wt. % or at most 60 wt. %. Further, the amount of conjugated aliphatic compounds having two or more carbon-carbon double bonds in the liquid hydrocarbon feedstock stream, based on the total weight of the liquid hydrocarbon feedstock stream, may be greater than 0 wt. % or at least 10 wt. % or at least 20 wt. % or at least 40 wt. % or at least 60 wt. % and may be at most 80 wt. % or at most 60 wt. % or at most 40 wt. %.

Within the present specification, an aliphatic hydrocarbon which contains one or more heteroatoms is a "heteroatom containing organic compound" as further described below. Unless indicated otherwise, either explicitly or by context, within the present specification, the term "aliphatic hydrocarbons" does not include heteroatom containing aliphatic hydrocarbons. Further, unless indicated otherwise, either explicitly or by context, within the present specification, the term "aliphatic hydrocarbons" does not include conjugated aliphatic compounds having two or more carbon-carbon double bonds.

In addition to the above-described aliphatic hydrocarbons, the liquid hydrocarbon feedstock stream comprises heteroatom containing organic compounds and optionally aromatic hydrocarbons.

The amount of aromatic hydrocarbons in the liquid hydrocarbon feedstock stream, based on the total weight of the liquid hydrocarbon feedstock stream, may be 0 wt. % or greater than 0 wt. % or at least 5 wt. % or at least 10 wt. % or at least 15 wt. % or at least 20 wt. % or at least 25 wt. % or at least 30 wt. % and may be at most 50 wt. % or at most 40 wt. % or at most 30 wt. % or at most 20 wt. %. The aromatic hydrocarbons may comprise monocyclic and/or polycyclic aromatic hydrocarbons. An example of a monocyclic aromatic hydrocarbon is styrene. The polycyclic aromatic hydrocarbons may comprise non-fused and/or fused polycyclic aromatic hydrocarbons. An example of a non-fused polycyclic aromatic hydrocarbon is oligostyrene. Styrene and oligostyrene may originate from polystyrene. Examples of fused polycyclic aromatic hydrocarbons are naphthalene and anthracene, as well as alkyl naphthalene and alkyl anthracene. The aromatic ring or rings in the aromatic hydrocarbons may be substituted by one or more hydrocarbyl groups, including alkyl groups (saturated) and alkylene groups (unsaturated).

Within the present specification, an aromatic hydrocarbon which contains one or more heteroatoms is a "heteroatom containing organic compound" as further described below. Unless indicated otherwise, either explicitly or by context, within the present specification, the term "aromatic hydrocarbons" does not include heteroatom containing aromatic hydrocarbons.

Further, the amount of heteroatom containing organic compounds in the liquid hydrocarbon feedstock stream, based on the total weight of the liquid hydrocarbon feedstock stream, is greater than 0 wt. % and may be at least 0.5 wt. % or at least 1 wt. % or at least 3 wt. % or at least 5 wt. % or at least 10 wt. % or at least 15 wt. % or at least 20 wt. % and may be at most 30 wt. % or at most 20 wt. % or at most 10 wt. % or at most 5 wt. %.

The heteroatom containing organic compounds in the liquid hydrocarbon feedstock stream contain one or more heteroatoms, which may be oxygen, nitrogen, sulfur and/or a halogen, such as chlorine, suitably oxygen, nitrogen and/or a halogen. The heteroatom containing organic compounds may comprise one or more of the following moieties: amine, imine, nitrile, alcohol, ether, ketone, aldehyde, ester, acid, amide, carbamate (occasionally named urethane) and urea.

Further, the above-mentioned heteroatom containing organic compounds may be aliphatic or aromatic. An example of an aliphatic, heteroatom containing organic compound is oligomeric polyvinyl chloride (PVC). Oligomeric PVC may originate from polyvinyl chloride. Aromatic, heteroatom containing organic compounds may comprise monocyclic and/or polycyclic aromatic, heteroatom containing organic compounds. Examples of monocyclic aromatic, heteroatom containing organic compounds are terephthalic acid and benzoic acid. An example of a polycyclic aromatic, heteroatom containing organic compound is oligomeric polyethylene terephthalate (PET). Terephthalic acid, benzoic acid and oligomeric PET may originate from polyethylene terephthalate. Examples of nitrogen containing organic compounds are compounds originating from polyurethane and polyamides including nylon.

Unless indicated otherwise, either explicitly or by context, within the present specification, the term "heteroatom containing organic compounds" means heteroatom containing organic compounds in or originating from the liquid hydrocarbon feedstock stream. Further, unless indicated otherwise, either explicitly or by context, within the present specification, the term "heteroatom containing organic compounds" does not include the extraction solvent, demixing solvent and/or washing solvent as defined in the present specification.

Additionally, the liquid hydrocarbon feedstock stream may comprise salts. Said salts may comprise organic and/or inorganic salts. The salts may comprise ammonium, an alkali metal, an alkaline earth metal or a transition metal as the cation and a carboxylate, sulphate, phosphate or a halide as the anion.

Further, additionally, the liquid hydrocarbon feedstock stream may comprise silicon containing compounds, such as silica and siloxane compounds.

Preferably, at least part of the components in the liquid hydrocarbon feedstock stream, which comprises aliphatic hydrocarbons, heteroatom containing organic compounds and optionally aromatic hydrocarbons, are synthetic compounds, and not natural compounds as present in for example fossil oil. For example, such synthetic compounds include compounds originating from the pyrolysis of plastics synthesized from biomass, for example polyethylene synthesized from bio-ethanol through dehydration of the ethanol and subsequent polymerization of the ethylene thus formed.

Further, since in the present process heteroatom containing organic compounds are easily removed, the feed to the present process can advantageously tolerate a relatively high amount of such heteroatom containing organic compounds. Thus, waste plastic that may be pyrolyzed to produce a feed to the present process may comprise heteroatom-containing plastics, such as polyvinyl chloride (PVC), polyethylene terephthalate (PET) and polyurethane (PU). In specific, mixed waste plastic may be pyrolyzed that in addition to heteroatom-free plastics, such as polyethylene (PE) and polypropylene (PP), contains a relatively high amount of such heteroatom-containing plastics.

Step (i)—Pre-Wash of Liquid Hydrocarbon Feedstock Stream

In step (i) of the present process, before extraction step a), heteroatom containing organic compounds and optionally salts are removed from the liquid hydrocarbon feedstock stream by contacting at least part of that stream with a washing solvent d). Thus, step (i) precedes extraction step a) of the present process. Suitably, step (i) comprises mixing at least part of the liquid hydrocarbon feedstock stream with washing solvent d) and separating the resulting mixture into a first stream comprising washing solvent d), optionally salts and heteroatom containing compounds and a second stream comprising aliphatic hydrocarbons, heteroatom containing organic compounds and optionally aromatic hydrocarbons. At least part of the second stream resulting from step (i) is fed to step a), that is to say contacted with an extraction solvent a) in step a).

Further, in the present process, step (i) may be performed multiple times in series, that is to say at least two times, preferably two or three times, more preferably two times. The latter implies that the second stream comprising aliphatic hydrocarbons, heteroatom containing organic compounds, optionally salts and optionally aromatic hydrocarbons resulting from a first step (i) is sent to a second step (i) wherein further heteroatom containing organic compounds and optionally salts are removed from that second stream by contacting at least part of that stream with washing solvent d), which second step (i) also suitably comprises mixing at least part of that stream with washing solvent d) and separating the resulting mixture into a first stream comprising washing solvent d), heteroatom containing compounds and optionally salts and a second stream comprising aliphatic hydrocarbons, heteroatom containing organic compounds and optionally aromatic hydrocarbons. At least part of the second stream resulting from said second step (i) is fed to step a), that is to say contacted with an extraction solvent a) in step a), or to a further step (i).

Depending on the partition coefficient, heteroatom containing organic compounds and any aromatic hydrocarbons also end up in the second stream resulting from step (i) to a certain extent, wherein the second stream is more hydrophobic than the first stream. Thus, said second stream additionally comprises heteroatom containing organic compounds and optionally aromatic hydrocarbons, in addition to aliphatic hydrocarbons. Said first and second streams may additionally comprise conjugated aliphatic compounds having two or more carbon-carbon double bonds.

In step (i) washing solvent d) is added, separately from the liquid hydrocarbon feedstock stream and in addition to any washing solvent d), for example water, that may be present in the latter stream, and may be mixed with the latter stream. In step (i), it is preferred that a stream comprising washing solvent d) to be added comprises no or substantially no heteroatom containing organic compounds and salts, thereby enhancing the efficiency of removing heteroatom containing organic compounds and any salts from the liquid hydrocarbon feedstock stream. Advantageously, in the present invention, at least part of the first stream resulting from step c), which may contain no or substantially no heteroatom containing organic compounds and salts, may be used as such washing solvent d) stream for feeding (recycling) to step (i) in case such first stream resulting from step c) comprises washing solvent d), for example water.

The washing solvent d) in step (i) contains one or more heteroatoms, which may be oxygen, nitrogen and/or sulfur. It is preferred that said washing solvent d) has no or a relatively low miscibility in heptane. Preferably, washing solvent d) has such miscibility in heptane that at most 10 wt. % or at most 3 wt. % or at most 1 wt. % or at most 0.5 wt. % or at most 0.1 wt. % of washing solvent d), based on weight of heptane, is miscible in heptane. Further, it is preferred that the miscibility of washing solvent d) in heptane is lower than the miscibility of extraction solvent a) in heptane. The miscibility of a certain compound in another compound, such as heptane, may be determined by any general method known to a skilled person in the art, including ASTM method D1476. Where in the present specification reference is made to the miscibility of a compound in another compound, this means miscibility at 25° C.

Washing solvent d) in step (i) may have a Hansen solubility parameter distance $R_{a,heptane}$ with respect to heptane as determined at 25° C. of at least 10 $MPa^{1/2}$, preferably at least 20 $MPa^{1/2}$, more preferably at least 30 $MPa^{1/2}$, more preferably at least 40 $MPa^{1/2}$. Further, said $R_{a,heptane}$ for washing solvent d) may be at most 55 $MPa^{1/2}$, more preferably at most 50 $MPa^{1/2}$, more preferably at most 45 $MPa^{1/2}$. For example, said $R_{a,heptane}$ for water is 45 $MPa^{1/2}$. Hansen solubility parameters are further described hereinbelow in relation to extraction solvent a) used in step a).

Further, washing solvent d) in step (i) may have a solubility of sodium chloride, in g of NaCl per 100 g of solvent as determined at 25° C., of at least 0.1 g/100 g, preferably at least 0.3 g/100 g, more preferably at least 0.5 g/100 g, more preferably at least 0.7 g/100 g, more preferably at least 1 g/100 g, more preferably at least 2 g/100 g, more preferably at least 3 g/100 g, more preferably at least 4 g/100 g and most preferably at least 5 g/100 g, and may be at most 50 g/100 g or at most 40 g/100 g or at most 36 g/100 g. For example, said solubility of sodium chloride for water is 36 g/100 g.

Still further, washing solvent d) in step (i) may comprise one or more solvents selected from the group consisting of water, ammonia and organic solvents having a Hansen solubility parameter distance $R_{a,DEAA}$ with respect to diethylammonium acetate (DEAA) as determined at 25° C. of at most 15 $MPa^{1/2}$, preferably at most 13 $MPa^{1/2}$, more preferably at most 11 $MPa^{1/2}$. Further, said $R_{a,DEAA}$ for washing solvent d) may be at least 5 $MPa^{1/2}$, preferably at least 8 $MPa^{1/2}$, more preferably at least 10 $MPa^{1/2}$. For example, said $R_{a,DEAA}$ for monoethylene glycol (MEG) is 12 $MPa^{1/2}$. Further, preferably, said organic solvents for washing solvent d) have a $R_{a,heptane}$ which is greater than the $R_{a,DEAA}$ for the same solvent, wherein said difference in $R_{a,heptane}$ and $R_{a,DEAA}$ is at least 15 $MPa^{1/2}$, more preferably at least 16 $MPa^{1/2}$, most preferably at least 17 $MPa^{1/2}$. Further, preferably, said difference in $R_{a,heptane}$ and $R_{a,DEAA}$ is at most 25 $MPa^{1/2}$, more preferably at most 22 $MPa^{1/2}$, most preferably at most 20 $MPa^{1/2}$. For example, said difference in $R_{a,heptane}$ and $R_{a,DEAA}$ for monoethylene glycol is 16.3 $MPa^{1/2}$.

As mentioned above, the miscibilities, in heptane, of extraction solvent a) and washing solvent d) are preferably different in which case said solvents a) and d) are not identical. In specific, washing solvent d) may have a Hansen solubility parameter distance $R_{a,heptane}$ with respect to heptane as determined at 25° C. which is greater than such $R_{a,heptane}$ for extraction solvent a). Preferably, said difference in $R_{a,heptane}$ for solvents a) and d) is at least 1 $MPa^{1/2}$, more preferably at least 5 $MPa^{1"2}$, more preferably at least 10 $MPa^{1/2}$, more preferably at least 15 $MPa^{1/2}$, more preferably at least 20 $Mpa^{1/2}$, more preferably at least 25 $MPa^{1/2}$. Further, preferably, said difference in $R_{a,heptane}$ for solvents a) and d) is at most 55 $MPa^{1"2}$, more preferably at most 50 $MPa^{1/2}$, more preferably at most 45 $MPa^{1/2}$, more preferably at most 40 $Mpa^{1/2}$, more preferably at most 35 $MPa^{1/2}$, more preferably at most 30 $MPa^{1/2}$.

In specific, the washing solvent d) in step (i) of the present process may comprise one or more solvents selected from the group consisting of water, ammonia and organic solvents selected from the group consisting of diols and triols, including monoethylene glycol (MEG), monopropylene glycol (MPG) and glycerol; glycol ethers, including oligoethylene glycols, including diethylene glycol, triethylene glycol and tetraethylene glycol; amides, including formamide and monoalkyl formamides and acetamides, wherein the alkyl group may contain 1 to 8 or 1 to 3 carbon atoms, including methyl formamide; dialkylsulfoxide, wherein the alkyl group may contain 1 to 8 or 1 to 3 carbon atoms, including dimethylsulfoxide (DMSO); sulfones, including sulfolane; hydroxy esters, including lactates, including methyl and ethyl lactate; aminic compounds, including ethylenediamine, monoethanolamine, diethanolamine and triethanolamine; carbonate compounds, including propylene carbonate and glycerol carbonate; and cycloalkanone compounds, including dihydrolevoglucosenone. Further, said glycol ethers may include polyethylene glycols (PEG) which may have a molecular weight of 200 to 1,000 g/mole or 200 to 700 g/mole. Preferably, said washing solvent d) comprises one or more of water and above-mentioned diols and triols, in specific monoethylene glycol (MEG) and glycerol, and glycol ethers, in specific diethylene glycol, triethylene glycol and tetraethylene glycol. Further, in specific, said glycol ethers may include polyethylene glycols (PEG) which may have a molecular weight of 200 to 1,000 g/mole or 200 to 700 g/mole. More preferably, washing solvent d) comprises water, most preferably consists of water. In accordance with the present invention, washing solvent d) may comprise one or more solvents which are not mentioned above in combination with one or more solvents which are mentioned above, for example water, wherein the relative amount of the latter solvent(s) may vary within wide ranges and may be as low as for example 0.1 wt. % based on total washing solvent.

Washing solvent d) may be identical to or different from, preferably identical to, demixing solvent b) and/or below-described optional washing solvent c).

In step (i), a stream comprising washing solvent d), for example water, to be added may have a pH above 7 ("alkaline"), a pH below 7 ("acid") or a pH of about 7 ("neutral").

Further, in step (i), it may be preferred that a stream comprising washing solvent d), for example water, to be added has a pH above 7, more preferably of from 8 up to greater than 14, preferably of from 8 to 14, more preferably of from 10 to 14, most preferably of from 12 to 14. Such stream having such pH may be provided by adding one or more salts selected from the group consisting of alkali metal carbonates and bicarbonates, including sodium bicarbonate, sodium carbonate, lithium carbonate, lithium bicarbonate, potassium carbonate and potassium bicarbonate, and alkali metal or alkaline earth metal hydroxides, including lithium hydroxide, sodium hydroxide, potassium hydroxide and calcium hydroxide, and ammonium hydroxide, to a washing solvent d) stream, for example to part of the first stream resulting from step c) to be recycled to step (i) in case such first stream resulting from step c) comprises washing solvent d), for example water. In a case wherein step (i) comprises multiple steps in series, it is preferred that a stream comprising washing solvent d), for example water, to be fed to a first step (i) has a pH above 7, more preferably of from 8 up to greater than 14, more preferably of from 8 to 14, more preferably of from 10 to 14, most preferably of from 12 to 14, and a stream comprising washing solvent d), for example water, to be fed to a second step (i) and optionally to any subsequent step (i) has a pH in the range of from 6 to 8, preferably about 7.

Still further, in step (i), it may be preferred that a stream comprising washing solvent d), for example water, to be added has a pH below 7, more preferably of from lower than 1 to 6, more preferably of from 1 to 6, more preferably of from 2 to 5, most preferably of from 2 to 4. Such stream having such pH may be provided by adding an inorganic acid (mineral acid) or an organic acid to a washing solvent d) stream. Suitably, one or more inorganic acids selected from the group consisting of hydrochloric acid, nitric acid, phosphoric acid, boric acid, perchloric acid, hydrofluoric acid, hydroiodic acid and sulfuric acid may be added. And/or, suitably, one or more organic acids selected from the group consisting of sulfonic acids, including methane sulfonic acid and p-toluene sulfonic acid, and carboxylic acids, including formic acid, oxalic acid, acetic acid, lactic acid, uric acid, malic acid, tartaric acid and citric acid, may be added. Further, suitably, the acidity of the acid stream can be provided by an ion-exchange resin or ion-exchange polymer comprising an organic polymer, such as polystyrene sulfonate or polystyrene crosslinked with divinylbenzene, where the ion-exchange sites are introduced after polymerization by functionalization with an acid group, for example sulfonic or carboxylic acid groups.

Still further, in step (i), it may be preferred that a stream comprising washing solvent d), for example water, to be added has a pH of about 7.

The temperature at which step (i) is carried out may be in the range of from 4 to 300° C., more preferably in the range of from 4 to 200° C. The pressure at which step (i) is carried out may be in the range of from atmospheric pressure to 100 bar, more preferably in the range of from atmospheric pressure to 20 bar.

Step (i) may be performed continuously or batchwise, preferably continuously. Further, mixing in step (i) may be performed in any way known to a skilled person. For example, a mixer may be used upstream of a phase separation apparatus as described below. Further, for example, in-line (or static) mixing may be performed upstream of such phase separation apparatus. Still further, mixing may be effected in an extraction column as described below.

Through such addition of washing solvent d) and mixing in step (i), a first phase comprising washing solvent d), heteroatom containing compounds and optionally salts and a second phase comprising aliphatic hydrocarbons, heteroatom containing organic compounds and optionally aromatic hydrocarbons result from step (i), which phases may be separated into above-mentioned first stream and second stream, respectively. Thus, advantageously, said washing solvent d) as added in step (i) separately from the liquid hydrocarbon feedstock stream, removes part of the heteroatom containing organic compounds and any salts from the aliphatic hydrocarbons to be recovered, thereby at the same time preventing a build-up of such contaminants in the downstream part of the present process, that is to say in steps a), b) and c), and thus increasing the stability and reliability of the overall process.

The phase separation in step (i) may be performed by any apparatus capable of separating two phases, including a decanter, a flotation device, a coalescer and a centrifuge, suitably a decanter. The phase separation in step (i) may be carried out in a single stage, for example in a decanter, a flotation device, a coalescer or a centrifuge. For example, when using a decanter in step (i), an upper phase comprising aliphatic hydrocarbons, heteroatom containing organic compounds and optionally aromatic hydrocarbons and a lower phase comprising washing solvent d), heteroatom containing compounds and optionally salts may be separated into said second stream and first stream, respectively.

Further, step (i) may be carried out in an extraction column comprising multiple separation stages. In the latter case, step (i) comprises contacting at least part of the liquid hydrocarbon feedstock stream with washing solvent d) in the column and subjecting said feedstock stream to liquid-liquid extraction with the washing solvent d), resulting in a first stream comprising washing solvent d), heteroatom containing compounds and optionally salts and a second stream comprising aliphatic hydrocarbons, heteroatom containing organic compounds and optionally aromatic hydrocarbons, wherein said washing solvent d) may be fed to the extraction column at a position which is higher than the position at which said feedstock stream is fed, thereby enabling a counterflow liquid-liquid extraction and resulting in a top stream from the extraction column (above "second stream") comprising aliphatic hydrocarbons, heteroatom containing organic compounds and optionally aromatic hydrocarbons and a bottom stream from the extraction column (above "first stream") comprising washing solvent d), heteroatom containing compounds and optionally salts.

Internals in the above-mentioned extraction column contribute to the mixing of the feedstock stream and the washing solvent d). Such column internals are known in the art. The column internals may comprise a packing such as Raschig rings, Pall rings, Lessing rings, Bialecki rings, Dixon rings; sieving plates; or a random structured packing, among others, as described in Perry's Chemical Engineer's Handbook. Furthermore, the column may be provided with stirring means. For example, a shaft may run along the column and may be provided with rotors and stators fixed to the column.

Thus, advantageously, already in step (i) before step a), any salts are removed and part of the heteroatom containing organic compounds is removed from the aliphatic hydrocarbons to be recovered from the liquid hydrocarbon feedstock stream, so that there is a reduced need to effect separation of such heteroatom containing organic compounds in subsequent extraction step a). Further, complications relating to a build-up and potential precipitation of salts in subsequent steps may be avoided by already removing any salts in a first step. Thus, not only may the efficiency of extraction step a) be improved, but at the same time, a build-up of all of such contaminants (heteroatom containing organic compounds and any salts) in the downstream part of the present process, that is to say in steps a), b) and c), may advantageously be prevented and thus the stability and reliability of the overall process may be increased.

At least part of the first stream comprising washing solvent d), heteroatom containing compounds and optionally salts resulting from step (i) may be recycled to step (i), whereas another part may be bled from the process. The heteroatom containing organic compounds removed in step (i) may be converted into fuel, optionally after a hydrotreatment to remove the heteroatoms. Further, said compounds removed in step (i) may be further separated into various fractions which may be used as solvents.

In a case wherein step (i) comprises multiple steps in series, in a first step (i) at least part of the liquid hydrocarbon feedstock stream may be mixed with washing solvent d), preferably with a washing solvent d) stream having a pH of from 8 up to greater than 14 as described above, and the resulting phases may be separated in a decanter, a flotation device, a coalescer and a centrifuge, suitably a decanter, as described above, resulting in a first stream comprising washing solvent d), heteroatom containing compounds and optionally salts and a second stream comprising aliphatic hydrocarbons, heteroatom containing organic compounds, optionally salts and optionally aromatic hydrocarbons, and in a second step (i) at least part of the second stream resulting from the first step (i) may be contacted with washing solvent d), preferably with a washing solvent d) stream having a pH of from 6 to 8, preferably about 7, for example in an extraction column as described above, and said second stream may be subjected to liquid-liquid extraction with washing solvent d), resulting in a first stream comprising washing solvent d), heteroatom containing compounds and optionally salts and a second stream comprising aliphatic hydrocarbons, heteroatom containing organic compounds and optionally aromatic hydrocarbons, and wherein at least part of the second stream resulting from the second step (i) may be fed to step a).

Step a)—Extraction with Extraction Solvent a)

In step a) of the present process, at least part of the liquid hydrocarbon feedstock stream, comprising aliphatic hydrocarbons, heteroatom containing organic compounds and optionally aromatic hydrocarbons, from which any salts and part of the heteroatom containing organic compounds are removed by contacting at least part of that stream with washing solvent d) in preceding step (i), is contacted with an extraction solvent a) which contains one or more heteroatoms, and the liquid hydrocarbon feedstock stream is subjected to liquid-liquid extraction with the extraction solvent a), resulting in a first stream comprising aliphatic hydrocarbons and a second stream comprising extraction solvent a), heteroatom containing organic compounds and optionally aromatic hydrocarbons.

In step a) of the present process, the liquid hydrocarbon feedstock stream may be fed to a first column (first extraction column). Further, a first solvent stream which comprises the extraction solvent a) may be fed to the first column at a position which is higher than the position at which the liquid hydrocarbon feedstock stream is fed, thereby enabling a counterflow liquid-liquid extraction and resulting in a top stream from the first column (above "first stream") comprising aliphatic hydrocarbons and a bottom stream from the first column (above "second stream") comprising extraction solvent a), heteroatom containing organic compounds and optionally aromatic hydrocarbons.

In step a), the weight ratio of the extraction solvent a) to the liquid hydrocarbon feedstock stream may be at least 0.05:1 or at least 0.2:1 or at least 0.5:1 or at least 1:1 or at least 2:1 or at least 3:1 and may be at most 5:1 or at most 3:1 or at most 2:1 or at most 1:1. Further, the temperature in step a) may be at least 0° C. or at least 20° C. or at least 30° C. or at least 40° C. or at least 50° C. and may be at most 200° C. or at most 150° C. or at most 100° C. or at most 70° C. or at most 60° C. or at most 50° C. or at most 40° C. The pressure in step a) may be at least 100 mbara or at least 500 mbara or at least 1 bara or at least 1.5 bara or at least 2 bara and may be at most 50 bara or at most 30 bara or at most 20 bara or at most 15 bara or at most 10 bara or at most 5 bara or at most 3 bara or at most 2 bara or at most 1.5 bara. The temperature and pressure in step a) are preferably such that both the hydrocarbons from the feedstock stream and the extraction solvent a) are in the liquid state.

In step a), aliphatic hydrocarbons are recovered by liquid-liquid extraction of heteroatom containing organic compounds and optionally aromatic hydrocarbons with extraction solvent a). Further, preferably, the recovered aliphatic hydrocarbons comprise aliphatic hydrocarbons having a boiling point of from 30 to 300° C. and aliphatic hydrocarbons having a boiling point of from greater than 300 to 600° C. in a weight ratio of from 99:1 to 1:99. The above description of the weight ratio of aliphatic hydrocarbons having a boiling point of from 30 to 300° C. to aliphatic hydrocarbons having a boiling point of from greater than 300 to 600° C. in relation to aliphatic hydrocarbons in the liquid hydrocarbon feedstock stream also applies to the recovered aliphatic hydrocarbons.

In step a), said liquid-liquid extraction results in a first stream comprising aliphatic hydrocarbons and a second stream comprising extraction solvent a), heteroatom containing organic compounds and optionally aromatic hydrocarbons. Within the present specification, the former stream (first stream) comprising recovered aliphatic hydrocarbons may also be referred to as a "raffinate stream" and the latter stream (second stream) may also be referred to as an "extract stream". Such raffinate stream has a reduced content of aromatic hydrocarbons, conjugated aliphatic compounds having two or more carbon-carbon double bonds, and heteroatom containing organic compounds. Such raffinate stream comprises no or at most 10 wt. % or at most 5 wt. % or at most 1 wt. % or substantially no aromatic hydrocarbons. Further, such raffinate stream comprises no or at most 15 wt. % or at most 10 wt. % or at most 5 wt. % or at most 1 wt. % or substantially no conjugated aliphatic compounds having two or more carbon-carbon double bonds. Further, such raffinate stream comprises no or at most 1 wt. % or substantially no heteroatom containing organic compounds.

The extraction solvent a) used in step a) of the present process, which may be fed as a first solvent stream to a first column in step a), preferably has a density which is at least 3% or at least 5% or at least 8% or at least 10% or at least 15% or at least 20% higher than the density of the liquid hydrocarbon feedstock stream. Further, said density may be at most 50% or at most 40% or at most 35% or at most 30% higher than the density of the liquid hydrocarbon feedstock stream.

Further, the extraction solvent a) used in step a) contains one or more heteroatoms, which may be oxygen, nitrogen and/or sulfur. Still further, it is preferred that said extraction solvent a) is thermally stable at a temperature of 200° C. Still further, said extraction solvent a) may have a boiling point which is at least 50° C. or at least 80° C. or at least 100° C. or at least 120° C. and at most 300° C. or at most 200° C. or at most 150° C. Still further, it is preferred that said extraction solvent a) has no or a relatively low miscibility in heptane. Preferably, extraction solvent a) has such miscibility in heptane that at most 30 wt. % or at most 20 wt. % or at most 10 wt. % or at most 3 wt. % or at most 1 wt. % of extraction solvent a), based on weight of heptane, is miscible in heptane. The miscibility of a certain compound in another compound, such as heptane, may be determined by any general method known to a skilled person in the art, including ASTM method D1476. Where in the present specification reference is made to the miscibility of a compound in another compound, this means miscibility at 25° C.

Further, the extraction solvent a) in step a) may have a Hansen solubility parameter distance $R_{a,heptane}$ with respect to heptane as determined at 25° C. of at least 3 $MPa^{1/2}$, preferably at least 5 $MPa^{1/2}$, more preferably at least 10 $Mpa^{1/2}$, more preferably at least 15 $MPa^{1/2}$. Further, said $R_{a,heptane}$ for extraction solvent a) may be lower than 45 $MPa^{1/2}$ or at most 40 $MPa^{1"2}$, preferably at most 35 $MPa^{1/2}$, more preferably at most 30 $MPa^{1/2}$, more preferably at most 25 $Mpa^{1/2}$. For example, said $R_{a,heptane}$ for N-methylpyrrolidone (NMP) is 15 $MPa^{1/2}$.

Still further, said extraction solvent a) may have a difference in Hansen solubility parameter distance $R_{a,heptane}$ with respect to heptane compared to Hansen solubility parameter distance $R_{a,toluene}$ with respect to toluene (i.e. $R_{a,heptane}$—$R_{a,toluene}$) as determined at 25° C. of at least 1.5 $MPa^{1/2}$, preferably at least 2 $MPa^{1/2}$. Further, said difference in $R_{a,heptane}$ compared to $R_{a,toluene}$ for extraction solvent a) may be at most 4.5 $MPa^{1/2}$, preferably at most 4 $MPa^{1/2}$.

Hansen solubility parameters (HSP) can be used as a means for predicting the likeliness of one component compared to another component. More specifically, each component is characterized by three Hansen parameters, each generally expressed in $MPa^{0.5}$: $\delta_d$, denoting the energy from dispersion forces between molecules; $\delta_p$, denoting the energy from dipolar intermolecular forces between molecules; and $\delta_h$, denoting the energy from hydrogen bonds between molecules. The affinity between compounds can be described using a multidimensional vector that quantifies these solvent atomic and molecular interactions, as a Hansen solubility parameter (HSP) distance $R_a$ which is defined in Equation (1):

$$(R_a)^2=4(\delta_{d2}-\delta_{d1})^2+(\delta_{p2}-\delta_{p1})^2+(\delta_{h2}-\delta_{h1})^2 \quad (1)$$

wherein $R_a$=distance in HSP space between compound 1 and compound 2 ($MPa^{0.5}$)

$\delta_{d1}$, $\delta_{p1}$, $\delta_{h1}$=Hansen (or equivalent) parameter for compound 1 (in $MPa^{0.5}$)

$\delta_{d2}$, $\delta_{p2}$, $\delta_{h2}$=Hansen (or equivalent) parameter for compound 2 (in $MPa^{0.5}$)

Thus, the smaller the value for $R_a$ for a given solvent calculated with respect to the compound to be recovered (i.e., the compound to be recovered being compound 1 and the solvent being compound 2, or vice versa), the higher the affinity of this solvent for the compound to be recovered will be.

Hansen solubility parameters for numerous solvents can be found in, among others, *CRC Handbook of Solubility Parameters and Other Cohesion Parameters, Second Edition* by Allan F. M. Barton, CRC press 1991; *Hansen Solubility Parameters: A User's Handbook* by Charles M. Hansen, CRC press 2007.

In specific, the extraction solvent a) used in step a) of the present process may comprise ammonia or, preferably, one or more organic solvents selected from the group consisting of diols and triols, including monoethylene glycol (MEG), monopropylene glycol (MPG), any isomer of butanediol and glycerol; glycol ethers, including oligoethylene glycols, including diethylene glycol, triethylene glycol and tetraethylene glycol, and monoalkyl ethers thereof, including diethylene glycol ethyl ether; amides, including N-alkylpyrrolidone, wherein the alkyl group may contain 1 to 8 or 1 to 3 carbon atoms, including N-methylpyrrolidone (NMP), formamide and di- and monoalkyl formamides and acetamides, wherein the alkyl group may contain 1 to 8 or 1 to 3 carbon atoms, including dimethyl formamide (DMF), methyl formamide and dimethyl acetamide; dialkylsulfoxide, wherein the alkyl group may contain 1 to 8 or 1 to 3 carbon atoms, including dimethylsulfoxide (DMSO); sulfones, including sulfolane; N-formyl morpholine (NFM); furan ring containing components and derivatives thereof, including furfural, 2-methyl-furan, furfuryl alcohol and tetrahydrofurfuryl alcohol; hydroxy esters, including lactates, including methyl and ethyl lactate; trialkyl phosphates, including triethyl phosphate; phenolic compounds, including phenol and guaiacol; benzyl alcoholic compounds, including benzyl alcohol; aminic compounds, including ethylenediamine, monoethanolamine, diethanolamine and triethanolamine; nitrile compounds, including acetonitrile and propionitrile; trioxane compounds, including 1,3,5-trioxane; carbonate compounds, including propylene carbonate and glycerol carbonate; and cycloalkanone compounds, including dihydrolevoglucosenone.

More preferably, said extraction solvent a) comprises one or more of above-mentioned dialkylsulfoxide, in specific DMSO; sulfones, in specific sulfolane; above-mentioned N-alkylpyrrolidone, in specific NMP; and a furan ring containing component, in specific furfural. Even more preferably, said extraction solvent a) comprises one or more of above-mentioned N-alkylpyrrolidone, in specific NMP, and a furan ring containing component, in specific furfural. Most preferably, extraction solvent a) comprises NMP.

An aqueous solution of a quaternary ammonium salt, in specific trioctyl methyl ammonium chloride or methyl tributyl ammonium chloride, may also be used as the extraction solvent a) in step a).

In addition to extraction solvent a), a washing solvent, such as water, may also be added to step a). This washing solvent is herein referred to as washing solvent c) and is further described below. In such case, step a) preferably results in a first stream comprising aliphatic hydrocarbons and a second stream comprising washing solvent c), extraction solvent a), heteroatom containing organic compounds and optionally aromatic hydrocarbons. Thus, advantageously, said washing solvent c) as added in step a), functions as an extraction solvent extracting extraction solvent a) and thereby making it possible that no or substantially no extraction solvent a) ends up in the first stream resulting from step a) and comprising recovered aliphatic hydrocarbons. In case washing solvent c) is also added to step a), the weight ratio of extraction solvent a) to washing solvent c) in step a) may be at least 0.5:1 or at least 1:1 or at least 2:1 or at least 3:1 and may be at most 30:1 or at most 25:1 or at most 20:1 or at most 15:1 or at most 10:1 or at most 5:1 or at most 3:1 or at most 2:1.

In case washing solvent c) is also added to step a), a second solvent stream which comprises washing solvent c) may be fed to the above-mentioned first column (first extraction column) at a position which is higher than the position at which the above-mentioned first solvent stream which comprises the extraction solvent a) is fed, thereby enabling a counterflow liquid-liquid extraction and resulting in a top stream from the first column (above "first stream") comprising aliphatic hydrocarbons and a bottom stream from the first column (above "second stream") comprising washing solvent c), extraction solvent a), heteroatom containing organic compounds and optionally aromatic hydrocarbons. In the above case, the first solvent stream in extraction step a) may comprise demixing solvent b), such as water, and/or above-mentioned optional washing solvent c) in addition to extraction solvent a). Demixing solvent b) is also further described below. Said demixing solvent b) and washing solvent c) may originate from one or more recycle streams after step c) of the present process.

In case washing solvent c) is also added to step a), it is preferred that the stream comprising washing solvent c) to be added comprises no or substantially no heteroatom containing organic compounds originating from the liquid hydrocarbon feedstock stream. This preference applies especially in a case where said stream is fed to the first extraction column at a relatively high position, as described above, where these heteroatom containing organic compounds could re-contaminate the raffinate (top) stream resulting from step a). Advantageously, in the present invention, at least part of the demixing solvent b) containing stream resulting from step c), which may contain no or substantially no heteroatom containing organic compounds, may be used as such washing solvent c) stream for feeding (recycling) to step a), especially in case demixing solvent b) is identical to washing solvent c), especially water.

As mentioned above, the second stream resulting from step a), which stream for the above-mentioned first (extraction) column corresponds with the bottom stream from such column, comprises extraction solvent a), heteroatom containing organic compounds and optionally aromatic hydrocarbons. Said stream may additionally comprise conjugated aliphatic compounds having two or more carbon-carbon double bonds in a case wherein such compounds are present in the liquid hydrocarbon feedstock stream.

In the present invention, extraction solvent a) is recovered from the second stream resulting from step a) and then advantageously recycled to step a), through steps b), c) and d) of the present process.

Step b)—Demixing with Demixing Solvent b)

In overall step b) of the present process, at least part of the second stream resulting from step a), comprising extraction solvent a), aliphatic hydrocarbons, heteroatom containing organic compounds and optionally aromatic hydrocarbons, is mixed with a demixing solvent b) which contains one or more heteroatoms and has a miscibility in heptane which is lower than the miscibility of extraction solvent a) in heptane, and the resulting mixture is separated into one stream comprising extraction solvent a) and demixing solvent b) and another stream comprising compounds to be separated from the former stream, in at least two sub-steps, for example two to five sub-steps, preferably two or three sub-steps. That is to say, in each of these sub-steps, there is a mixing with demixing solvent b) followed by a separation of resulting streams, wherein the separated stream comprising extraction solvent a) and demixing solvent b) is fed to the following sub-step wherein it is mixed with an additional portion of demixing solvent b). By this staged (stepwise or incremental) addition of demixing solvent b) in several portions, rather than adding the total amount of demixing solvent b) in one step only, the relative amount of demixing solvent b) in each separated stream comprising extraction solvent a) and demixing solvent b) (second stream) leaving a sub-step gradually increases and after each sub-step said second stream becomes less hydrophobic. This advantageously results in that in each sub-step the composition of the stream (first stream) separated from said stream comprising extraction solvent a) and demixing solvent b) (second stream) and containing compounds to be recovered or removed (i.e. separated) is different. Advantageously, the amount of aliphatic hydrocarbons in the first stream resulting from the first sub-step in step b) is relatively high, which enables a recovery from such additional aliphatic hydrocarbons, which may either be recycled to step a) and/or combined with the raffinate stream resulting from step a), preferably before such raffinate stream is fed to below-mentioned optional additional step wherein that stream is contacted with washing solvent c). On the other hand, the relative amount of heteroatom containing organic compounds and optionally aromatic hydrocarbons in the first stream resulting from a later (downstream) sub-step in step b) is relatively high, which enables a removal of these contaminants from the process without losing a significant amount of additional aliphatic hydrocarbons as already recovered in a preceding sub-step in step b).

Accordingly, in step b1) of the present process, also herein referred to as sub-step b1), at least part of the second stream resulting from step a) is mixed with demixing solvent b) and the resulting mixture is separated into a first stream comprising aliphatic hydrocarbons and optionally aromatic hydrocarbons and a second stream comprising extraction solvent a), demixing solvent b), heteroatom containing organic compounds and optionally aromatic hydrocarbons.

Further, accordingly, in step b2) of the present process, also herein referred to as sub-step b2), at least part of the second stream resulting from step b1) is mixed with demixing solvent b) and the resulting mixture is separated into a first stream comprising heteroatom containing organic compounds and optionally aromatic hydrocarbons and a second stream comprising extraction solvent a) and demixing solvent b).

Further, the demixing solvent b) used in step b) contains one or more heteroatoms, which may be oxygen, nitrogen and/or sulfur. Still further, it is preferred that just like extraction solvent a), said demixing solvent b) has no or a relatively low miscibility in heptane. Preferably, demixing solvent b) has such miscibility in heptane that at most 10 wt. % or at most 3 wt. % or at most 1 wt. % or at most 0.5 wt. % or at most 0.1 wt. % of demixing solvent b), based on weight of heptane, is miscible in heptane. In the present invention, the miscibility of demixing solvent b) in heptane is lower than the miscibility of extraction solvent a) in heptane. The miscibility of said solvents a) and b) in heptane may be determined by any general method known to a skilled person in the art, including above-mentioned ASTM method D1476. Further, suitably, demixing solvent b) is miscible in extraction solvent a). This implies that up to 50 wt. % of demixing solvent b), based on total amount of demixing solvent b) and extraction solvent a), can be mixed in extraction solvent a).

Further, the demixing solvent b) in step b) may have a Hansen solubility parameter distance $R_{a,heptane}$ with respect to heptane as determined at 25° C. of at least 10 $MPa^{1/2}$, preferably at least 20 $MPa^{1/2}$, more preferably at least 30 $Mpa^{1/2}$, more preferably at least 40 $MPa^{1/2}$. Further, said $R_{a,heptane}$ for demixing solvent b) may be at most 55 $MPa^{1/2}$, more preferably at most 50 $MPa^{1/2}$, more preferably at most 45 $MPa^{1/2}$. For example, said $R_{a,heptane}$ for water is 45 $MPa^{1/2}$.

As mentioned above, the miscibilities, in heptane, of extraction solvent a) and demixing solvent b) are different. Hence, said solvents a) and b) are not identical. In specific, demixing solvent b) may have a Hansen solubility parameter distance $R_{a,heptane}$ with respect to heptane as determined at 25° C. which is greater than such $R_{a,heptane}$ for extraction solvent a). Preferably, said difference in $R_{a,heptane}$ for solvents a) and b) is at least 1 $MPa^{1/2}$, more preferably at least 5 $MPa^{1/2}$, more preferably at least 10 $MPa^{1/2}$, more preferably at least 15 $MPa^{1/2}$, more preferably at least 20 $Mpa^{1/2}$, more preferably at least 25 $MPa^{1/2}$. Further, preferably, said difference in $R_{a,heptane}$ for solvents a) and b) is at most 55 $MPa^{1/2}$, more preferably at most 50 $MPa^{1/2}$, more preferably at most 45 $MPa^{1/2}$, more preferably at most 40 $Mpa^{1/2}$, more preferably at most 35 $MPa^{1/2}$, more preferably at most 30 $MPa^{1/2}$.

In specific, the demixing solvent b) used in step b) of the present process may comprise one or more solvents selected from the group consisting of water and the solvents from the group of solvents as defined hereinabove for extraction solvent a). Preferably, said demixing solvent b) comprises one or more of water and above-mentioned diols and triols, in specific monoethylene glycol (MEG) and glycerol. More preferably, demixing solvent b) comprises water, most preferably consists of water. Other preferences and embodiments as described above with reference to the extraction solvent a) used in step a) also apply to demixing solvent b), with the exception that demixing solvent b) is not identical to extraction solvent a), as it has a lower miscibility in heptane, and that demixing solvent b) may comprise and preferably comprises water.

In the process of the present invention, step b) comprises two or more sub-steps, including steps b1) and b2) which are sub-steps of step b). Suitably, the present process comprises of from 2 to 10, more suitably of from 2 to 5, sub-steps in step b). Said number of sub-steps in step b) is at least 2 and may be at least 3 or at least 4, and may be at most 10 or at most 8 or at most 6.

For example, in a case wherein step b) comprises two sub-steps, in the first sub-step aliphatic hydrocarbons and any aromatic hydrocarbons may be rejected via the first stream resulting from step b1), and in the second sub-step heteroatom containing organic compounds may be rejected via the first stream resulting from step b2).

Thus, step b) of the present process may comprise more than two sub-steps. For example, in a case wherein step b) comprises three sub-steps, in the first sub-step aliphatic hydrocarbons may be rejected, in the second sub-step any aromatic hydrocarbons may be rejected, and in the third sub-step heteroatom containing organic compounds may be rejected.

Further, in specific, in such case wherein the present process comprises more than two sub-steps in step b), step b) may comprise:

bi) mixing at least part of the second stream resulting from step a) with demixing solvent b) and separating the resulting mixture into a first stream comprising aliphatic hydrocarbons and optionally aromatic hydrocarbons and a second stream comprising extraction solvent a), demixing solvent b), aliphatic hydrocarbons, heteroatom containing organic compounds and optionally aromatic hydrocarbons;

bii) mixing at least part of the second stream resulting from step bi) with demixing solvent b) and separating the resulting mixture into a first stream comprising aliphatic hydrocarbons, heteroatom containing organic compounds and optionally aromatic hydrocarbons and a second stream comprising extraction solvent a), demixing solvent b), heteroatom containing organic compounds and optionally aromatic hydrocarbons; and biii) mixing at least part of the second stream resulting from step bii) with demixing solvent b) and separating the resulting mixture into a first stream comprising heteroatom containing organic compounds and optionally aromatic hydrocarbons and a second stream comprising extraction solvent a) and demixing solvent b); and step c) may comprise separating at least part of the second stream resulting from step biii) into a first stream comprising demixing solvent b) and a second stream comprising extraction solvent a).

An additional advantage of the above-described process comprising sub-steps bi), bii) and biii), is that the first stream resulting from step bii) and comprising both (i) aliphatic hydrocarbons and (ii) heteroatom containing organic compounds and optionally aromatic hydrocarbons, need not be discarded but may still be used as a fuel, even though the relative amount of the heteroatom containing organic contaminants and any aromatic contaminants may be too high for it to be fed to a steam cracker. Said sub-step bi) corresponds with sub-step b1) whereas said sub-step biii) corresponds with sub-step b2).

Thus, in the present invention, the composition of the various first streams resulting from the at least two sub-steps in step b) may advantageously be varied by increasing or decreasing the number of sub-steps, but also by varying the relative amount of demixing solvent b) as mixed in each of these sub-steps with the stream resulting from a preceding step. Such variation results in a different partition coefficient in each sub-step, causing a certain compound to preferentially end up in either the more hydrophobic first stream or the less hydrophobic second stream. The need for such variation may in turn depend on the desired outlet for each of said first streams (cracker feed, internal recycle, fuel, potential valuable product (e.g. solvent) or discard), on the composition of the feed to overall step b) and/or indirectly on the composition of the liquid hydrocarbon feedstock stream as fed to step a).

Further, any conjugated aliphatic compounds having two or more carbon-carbon double bonds may end up in the first or second stream resulting from a sub-step in step b), together with heteroatom containing organic compounds and optionally aromatic hydrocarbons. Generally, in the present invention, said conjugated aliphatic compounds may behave similarly as aromatic compounds so that these may end up in the same stream or streams as the optional aromatic hydrocarbons.

In each of the sub-steps of step b), demixing solvent b) is added, separately from the second stream resulting from step a) or the second stream resulting from a preceding sub-step in step b), and in addition to any demixing solvent b) that may be present in one of the latter streams, and mixed with one of the latter streams. In each of the sub-steps of step b), at least part of a second stream comprising washing solvent c), such as water, and extraction solvent a), resulting from the below-described optional, additional extraction step wherein at least part of the first stream resulting from step a), wherein said first stream comprises recovered aliphatic hydrocarbons and extraction solvent a), is subjected to liquid-liquid extraction with a washing solvent c), may be added to provide for said demixing solvent b) that needs to be added in step b).

The mixing in each of the sub-steps of step b) may be performed in any way known to a skilled person. For example, a mixer may be used upstream of a phase separation apparatus as described below. Further, for example, in-line (or static) mixing may be performed upstream of such phase separation apparatus. Still further, mixing may be effected in a column as described below.

Through such addition of demixing solvent b) and mixing in each of the sub-steps of step b), different phases are formed including a more hydrophobic, first phase and a less hydrophobic, second phase comprising extraction solvent a) and demixing solvent b), which phases are separated in each sub-step into said first stream and second stream, respectively. Thus, advantageously, said demixing solvent b) as added in step b) separately from the second stream resulting from step a) or the second stream resulting from a preceding sub-step in step b), functions as a so-called "demixer" (or "antisolvent"), thereby removing the more hydrophobic compounds from the extraction solvent a) to be recovered and recycled.

The phase separation in each of the sub-steps of step b) may be performed by any apparatus capable of separating two phases, including a decanter, a flotation device, a coalescer and a centrifuge, suitably a decanter. It is preferred that the phase separation in each of the sub-steps of step b) is carried out in a single stage, for example in a decanter, a flotation device, a coalescer or a centrifuge. For example, when using a decanter in step b), a first, upper phase comprising more hydrophobic compounds and a second, lower phase comprising extraction solvent a), demixing solvent b) and optionally less hydrophobic compounds (i.e. less hydrophobic than compounds in said first phase) may be separated into said first stream and second stream, respectively.

Further, each of the sub-steps of step b) may be carried out in a separate column comprising multiple separation stages. In the latter case, each sub-step comprises mixing at least part of the second stream resulting from step a) or the second stream resulting from a preceding sub-step in step b), respectively, with demixing solvent b) in the column and separating the resulting mixture into the above-mentioned first stream and second stream, suitably resulting in a top stream from the column (above "first stream") and a bottom stream from the column (above "second stream"). Preferably, said demixing solvent b) and the other, extraction solvent a) rich stream are fed co-currently to the column, at the bottom thereof.

Internals in the above-mentioned column contribute to the mixing of the extraction solvent a) rich stream and the demixing solvent b). Such column internals are known in the art. The column internals may comprise a packing such as Raschig rings, Pall rings, Lessing rings, Bialecki rings, Dixon rings; sieving plates; or a random structured packing, among others, as described in Perry's Chemical Engineer's Handbook. Furthermore, the column may be provided with stirring means. For example, a shaft may run along the column and may be provided with rotors and stators fixed to the column.

Still further, in the present invention, for step b) as a whole comprising multiple sub-steps, a single column comprising multiple separation stages may be used. The column that may be used in such case, may be the same as the column as described above for the case wherein each of the sub-steps of step b) is carried out in a separate column. In the case of using such single column, step b) of the present process may comprise:

b1) feeding at least part of the second stream resulting from step a) and demixing solvent b) to a first section of the column, mixing these, withdrawing a stream from the first section at a position downstream of the position at which demixing solvent b) is fed to the first section, and separating the withdrawn stream into a first stream comprising aliphatic hydrocarbons and optionally aromatic hydrocarbons and a second stream extraction solvent a), demixing solvent b), heteroatom containing organic compounds and optionally aromatic hydrocarbons; and b2) feeding at least part of the second stream resulting from step b1) and demixing solvent b) to a second section of the column, which second section is positioned downstream of the first section, mixing these, withdrawing a stream from the second section at a position downstream of the position at which demixing solvent b) is fed to the second section, and separating the withdrawn stream into a first stream comprising heteroatom containing organic compounds and optionally aromatic hydrocarbons and a second stream comprising extraction solvent a) and demixing solvent b).

In the above-mentioned case, wherein in step b) a single column is used for multiple sub-steps, the second stream resulting from step b2) may be either fed partially or completely to a next section positioned downstream of the second section of the column, as further described below, or recovered as a second stream comprising extraction solvent a) and demixing solvent b) at least part of which is fed to step c).

Further, in the above-mentioned case, wherein in step b) a single column is used for multiple sub-steps, the first section of such column may be positioned in the top or in the bottom of the column. Further, preferably, demixing solvent b) and the second stream resulting from step a) are fed co-currently to the first section of the column. In each sub-step of step b), phase separation may be performed by any apparatus capable of separating two phases, including a decanter, a flotation device, a coalescer and a centrifuge, suitably a decanter. Thus, phase separation takes place within such phase separation apparatus positioned outside of the column. Further, the column may comprise one or more further sections positioned downstream of the second section, in which case additional demixing solvent b) is also fed separately to each of these additional sections in addition to the second stream resulting from the preceding sub-step, these are mixed in such additional section, a stream from such additional section is withdrawn at a position downstream of the position at which demixing solvent b) is fed to that additional section, and the withdrawn stream is separated into a first stream comprising compounds to be separated from the demixing solvent b) and the extraction solvent a) and a second stream comprising extraction solvent a) and demixing solvent b).

Further, the above description of temperature and pressure in extraction step a) also applies to the above-mentioned sub-steps in overall step b). Still further, in overall step b), the weight ratio of the demixing solvent b), that is to say total demixing solvent b) added in said sub-steps, to the extraction solvent a), based on the amount of extraction solvent a) in the second stream resulting from step a), may be at least 0.005:1 or at least 0.01:1 or at least 0.5:1 or at least 1:1 or at least 2:1 and may be at most 10:1 or at most 7:1 or at most 5:1 or at most 4:1 or at most 2:1. Suitably, in overall step b), the total amount of demixing solvent b) added in all of the sub-steps in step b), based on total amount of (i) said total amount of demixing solvent b) and (ii) the amount of extraction solvent a) in the second stream resulting from step a), may be of from 0.1 to 45 wt. %, more suitably of from 1 to 40 wt. %, more suitably of from 5 to 35 wt. %, more suitably of from 10 to 30 wt. %.

Thus, in overall step b) of the present process, additional aliphatic hydrocarbons may advantageously be recovered separately from heteroatom containing organic compounds and optional aromatic hydrocarbons, which latter compounds are in turn advantageously removed from the extraction solvent a) to be recycled, so that there is no need to separate the extraction solvent a) from such removed compounds in a later step. Further, advantageously, any aromatic hydrocarbons and conjugated aliphatic compounds having two or more carbon-carbon double bonds removed in step b) may be blended with pygas and processed into fuel or used in the production of aromatic compounds. Likewise, the heteroatom containing organic compounds removed in step b) may also be converted into fuel, optionally after a hydrotreatment to remove the heteroatoms. Further, said compounds removed in step b) may be further separated into various fractions which may be used as solvents.

Step c)—Separation of Extraction Solvent a) and Demixing Solvent b)

In step c) of the present process, at least part of the second stream resulting from the last sub-step of step b), and comprising extraction solvent a) and demixing solvent b), is separated into a first stream comprising demixing solvent b) and a second stream comprising extraction solvent a). In case the below-described optional washing solvent c) is used in the present invention, which washing solvent c) may be identical to or different from, preferably identical to, demixing solvent b), such washing solvent c) may end up in said second stream resulting from the last sub-step of step b) and subsequently in said first stream resulting from step c).

Thus, a feed stream to step c) comprises at least part of the second stream resulting from the last sub-step of step b). In step c), demixing solvent b) and extraction solvent a) may be separated from each other in any known way, preferably by evaporation, for example through distillation. The latter separation may be performed in a distillation column. Advantageously, in distillation, at least part of any heteroatom containing organic compounds and aromatic hydrocarbons in the feed stream to step c) is removed azeotropically with the demixing solvent b), especially water.

Thus, it is preferred that step c) comprises separating at least part of the second stream resulting from the last sub-step of step b), by distillation into a top stream comprising demixing solvent b) and a bottom stream comprising extraction solvent a). In a case wherein the feed stream to step c) additionally comprises heteroatom containing organic compounds and optionally aromatic hydrocarbons, said top stream additionally comprises such compounds.

In the present invention, the amount of demixing solvent b) in the feed stream to step c) may be at least 10 wt. % or at least 20 wt. % and may be at most 70 wt. % or at most 50 wt. % or at most 40 wt. %. The second stream resulting from step c) may still comprise demixing solvent b), for example in an amount of at most 10 wt. % or at most 5 wt. % or at most 3 wt. % or at most 1 wt. %. Advantageously, in case the amount of demixing solvent b) in said second stream is relatively low, for example up to 5 wt. %, such demixing solvent b) does not need to be removed before extraction solvent a) from said same stream is recycled to step a) of the present process.

As mentioned above, in a case wherein the feed stream to the above-mentioned distillation step, as step c) in the present process, comprises heteroatom containing organic compounds and optionally aromatic hydrocarbons in addition to extraction solvent a) and demixing solvent b), the top stream resulting from the distillation step comprises demixing solvent b), heteroatom containing organic compounds and optionally aromatic hydrocarbons. For, advantageously, in distillation, at least part of said heteroatom containing organic compounds and aromatic hydrocarbons is removed azeotropically with the demixing solvent b), especially water. In the latter case, said top stream may be separated into two phases, one phase comprising demixing solvent b) and another phase comprising heteroatom containing organic compounds and optionally aromatic hydrocarbons. Such phase separation may be performed by any apparatus capable of separating two phases, including a decanter, a flotation device, a coalescer and a centrifuge, suitably a decanter. Advantageously, demixing solvent b) from such separated phase comprising demixing solvent b) may be recycled as further described below, whereas the other phase may be bled from the process thereby reducing the risk of any build-up of heteroatom containing organic compounds and aromatic hydrocarbons in the present process.

Recycle Steps

In step d) of the present process, at least part of the extraction solvent a) from the second stream resulting from step c) is recycled to step a).

The second stream resulting from step c) may additionally comprise aromatic hydrocarbons and/or heteroatom containing organic compounds. In a case where a stream comprising extraction solvent a) to be recycled to step a) comprises a relatively high amount of such compounds, additional demixing solvent b) may be added to step b) so as to prevent any build-up of these contaminants in such recycle stream to step a). Further, these contaminants may be removed before recycling extraction solvent a) to step a), by bleeding part of the stream comprising extraction solvent a) to be recycled to step a) wherein either such bleed stream may be discarded or extraction solvent a) may be recovered from such bleed stream, for example by distillation thereof.

Further, in optional step e) of the present process, at least part of the demixing solvent b) from the first stream resulting from step c) is recycled to one or more of the sub-steps of step b) and/or to step (i).

The latter recycle to one or more sub-steps of step b), in step e), is suitable in a case wherein said first stream resulting from step c) still comprises a relatively high amount of heteroatom containing organic compounds and/or aromatic hydrocarbons originating from the liquid hydrocarbon feedstock stream. However, in a case wherein such stream comprises no or substantially no or a relatively low amount of heteroatom containing organic compounds and/or aromatic hydrocarbons, which is advantageously enabled by step (i) and the overall separation step b), comprising at least two sub-steps, it is preferred to recycle at least part of the demixing solvent b) from such stream to step a) in case a washing solvent c), such as water, is added to step a) as described above or to the below-described optional, additional extraction step wherein such washing solvent c) is added, or to step (i) wherein washing solvent d) is added.

Separation of Extraction Solvent a) from Raffinate Stream

In a case wherein the stream comprising recovered aliphatic hydrocarbons resulting from the liquid-liquid extraction by the extraction solvent a) in step a) (raffinate stream) additionally comprises extraction solvent a), it is preferred that extraction solvent a) is separated from that stream which is the first stream resulting from step a), and is optionally recycled to step a). In this way, the recovered aliphatic hydrocarbons are advantageously separated from any extraction solvent a) in the above-mentioned raffinate stream, and the separated extraction solvent a) may advantageously be recycled to step a).

Extraction solvent a) may be separated from the above-mentioned first stream resulting from step a), wherein said stream comprises aliphatic hydrocarbons and extraction solvent a), in any way, including distillation, extraction, absorption and membrane separation.

In specific, in the above-mentioned case wherein the first stream resulting from step a) comprises aliphatic hydrocarbons and extraction solvent a), in an additional step, at least part of said first stream is contacted with a washing solvent c) and is subjected to liquid-liquid extraction with the washing solvent c), resulting in a first stream comprising aliphatic hydrocarbons and a second stream comprising washing solvent c) and extraction solvent a).

In the present invention, the optional washing solvent c) that may be used in the above-mentioned additional extraction step or that may be separately added to step a) or that may be added together with extraction solvent a) in a stream to step a), may be identical to or different from, preferably identical to, demixing solvent b). The preferences and embodiments as described above with reference to demixing solvent b) also apply to optional washing solvent c). Preferably, washing solvent c) comprises water, more preferably consists of water. Further, preferably, both demixing solvent b) and washing solvent c) comprise water, more preferably consist of water.

In the above-mentioned additional step, the first stream resulting from step a) and comprising aliphatic hydrocarbons and extraction solvent a) may be fed to a second column (second extraction column). Further, a second solvent stream which comprises washing solvent c) may be fed to the second column at a position which is higher than the position at which said first stream resulting from step a) is fed, thereby enabling a counterflow liquid-liquid extraction and resulting in a top stream from the second column (above "first stream") comprising aliphatic hydrocarbons and a bottom stream from the second column (above "second stream") comprising washing solvent c) and extraction solvent a).

Thus, advantageously, said washing solvent c) as added in the above-mentioned additional step, functions as an extraction solvent extracting extraction solvent a) thereby making it possible that advantageously no or substantially no extraction solvent a) ends up in the recovered aliphatic hydrocarbons. In the above-mentioned additional step, the weight ratio of extraction solvent a) to washing solvent c) may be at least 0.5:1 or at least 1:1 or at least 2:1 or at least 3:1 and may be at most 30:1 or at most 25:1 or at most 20:1 or at most 15:1 or at most 10:1 or at most 5:1 or at most 3:1 or at most 2:1. Further, the above description of temperature and pressure in extraction step a) also applies to the above-mentioned additional (extraction) step. In case the present process comprises the above-mentioned additional step, the first solvent stream in extraction step a) may comprise demixing solvent b) in addition to extraction solvent a) in which case the bottom stream from the first extraction column additionally comprises demixing solvent b).

In the above-mentioned additional step wherein washing solvent c) is added, it is preferred that the stream comprising washing solvent c) to be added comprises no or substantially no heteroatom containing organic compounds originating from the liquid hydrocarbon feedstock stream. This preference applies especially in a case where said stream is fed to the second extraction column at a relatively high position, as described above, where these heteroatom containing organic compounds could re-contaminate the raffinate (top) stream. Advantageously, in the present invention, at least part of the first stream resulting from step c) and comprising demixing solvent b) and optionally washing solvent c), which may contain no or substantially no heteroatom containing organic compounds originating from the liquid hydrocarbon feedstock stream, may be used as such washing solvent c) stream for feeding (recycling) to said additional step, especially in case demixing solvent b) is identical to washing solvent c), especially water.

Further, at least part of the second stream comprising washing solvent c) and extraction solvent a) resulting from the above-mentioned additional (extraction) step may be fed to step b) to provide for at least part of the demixing solvent b) that needs to be added in step b), especially in case demixing solvent b) is identical to washing solvent c). Thus, advantageously, such washing solvent c) may function both as an extraction solvent extracting residual extraction solvent a) in said additional step and as a so-called "demixer" (or "antisolvent") in step b), i.e. as demixing solvent b), as further discussed above.

In case a washing solvent other than water is fed to an extraction column for extracting extraction solvent a) used in step a), either in the above-mentioned additional step or in step a) itself as described above, it may be preferred that in addition to such other solvent, water is fed to the extraction column at a position which is higher than the position at which that other solvent is fed. In this way, advantageously, the water fed at the higher position may extract any washing solvent other than water away thereby preventing such other washing solvent from entering the (final) raffinate stream. Alternatively, the latter raffinate stream may be washed with water in a separate step.

Upstream and Downstream Integration

In the present invention, the liquid hydrocarbon feedstock stream may comprise at least part of a hydrocarbon product formed in a process comprising cracking of plastics, preferably waste plastics, more preferably mixed waste plastics, wherein at least part of the plastics comprises heteroatom containing organic compounds.

Accordingly, the present invention also relates to a process for the recovery of aliphatic hydrocarbons from plastics, wherein at least part of the plastics comprises heteroatom containing organic compounds, said process comprising the steps of:

(I) cracking the plastics and recovering a hydrocarbon product comprising aliphatic hydrocarbons, heteroatom containing organic compounds and optionally aromatic hydrocarbons; and (II) subjecting a liquid hydrocarbon feedstock stream, which comprises at least part of the hydrocarbon product obtained in step (I), to the above-described process for the recovery of aliphatic hydrocarbons from a liquid hydrocarbon feedstock stream.

The preferences and embodiments as described above with reference to the present aliphatic hydrocarbons recovery process as such also apply to step (II) of the present process for the recovery of aliphatic hydrocarbons from plastics. In above-mentioned step (I), the resulting hydrocarbon product may be either a liquid or a solid or wax. In the latter case, the solid or wax is first heated to make it liquid, before subjecting it to the aliphatic hydrocarbons recovery process in step (II).

In the above-mentioned process, at least part of the plastics as fed to step (I) comprises heteroatom containing organic compounds, which plastics are preferably waste plastics, more preferably mixed waste plastics. In said step (I), the cracking of the plastics may involve a thermal cracking process and/or a catalytic cracking process. The cracking temperature in step (I) may be of from 300 to 800° C., suitably of from 400 to 800° C., more suitably of from 400 to 700° C., more suitably of from 500 to 600° C. Further, any pressure may be applied, which pressure may be sub-atmospheric, atmospheric or super-atmospheric. Heat treatment in step (I) causes melting of the plastics and cracking of its molecules into smaller molecules. The cracking in step (I) may be carried out as pyrolysis or as liquefaction. Both in pyrolysis and in liquefaction a continuous liquid phase is formed. In addition, in pyrolysis a discontinuous gas phase is formed that escapes the liquid phase and segregates into a continuous gas phase. In liquefaction, there is no significant gas phase by applying a relatively high pressure.

Further, in step (I), subsequent condensation of a gas phase and/or cooling of a liquid phase provides a hydrocarbon product, which may be either a liquid or a solid or wax, comprising aliphatic hydrocarbons, heteroatom containing organic compounds and optionally aromatic hydrocarbons, at least part of which is subjected to the above-described aliphatic hydrocarbons recovery process in step (II).

Above-described step (I) may be carried out in any known way, for example in a way as disclosed in above-mentioned WO2018069794 and in WO2017168165, the disclosures of which are herein incorporated by reference.

Advantageously, aliphatic hydrocarbons as recovered in one of the above-described processes for the recovery of aliphatic hydrocarbons, which may comprise varying amounts of aliphatic hydrocarbons within a wide boiling point range, may be fed to a steam cracker without a further pre-treatment, such as treatment with hydrogen (hydrotreating or hydroprocessing) as disclosed in above-mentioned WO2018069794. In addition to being used as a feed to a steam cracker, said recovered aliphatic hydrocarbons may also advantageously be fed to other refining processes including hydrocracking, isomerization, hydrotreating, thermal catalytic cracking and fluid catalytic cracking. Further, in addition to being used as a feed to a steam cracker, said recovered aliphatic hydrocarbons may also advantageously be separated into different fractions which each may find a different application, such as diesel, marine fuel, solvent, etc.

Accordingly, the present invention also relates to a process for steam cracking a hydrocarbon feed, wherein the hydrocarbon feed comprises aliphatic hydrocarbons as recovered in one of the above-described processes for the recovery of aliphatic hydrocarbons. Further, accordingly, the present invention also relates to a process for steam cracking a hydrocarbon feed, comprising the steps of: recovering aliphatic hydrocarbons from a liquid hydrocarbon feedstock stream in one of the above-described processes for the recovery of aliphatic hydrocarbons; and steam cracking a hydrocarbon feed which comprises aliphatic hydrocarbons as recovered in the preceding step. In the present specification, said phrase "steam cracking a hydrocarbon feed which comprises aliphatic hydrocarbons as recovered in the preceding step" may mean "steam cracking a hydrocarbon feed which comprises at least part of the recovered aliphatic hydrocarbons". The hydrocarbon feed to the steam cracking process may also comprise hydrocarbons from another source, other than the present processes for the recovery of aliphatic hydrocarbons. Such other source may be naphtha, hydrowax or a combination thereof.

Advantageously, in a case wherein the liquid hydrocarbon feedstock stream comprises aromatic hydrocarbons, especially polycyclic aromatics, heteroatom containing organic compounds, conjugated aliphatic compounds having two or more carbon-carbon double bonds, or a combination thereof, these have already been removed by the present aliphatic hydrocarbons recovery process as described above before feeding recovered hydrocarbons to a steam cracking process. This is particularly advantageous in that said removed compounds, especially polycyclic aromatics, can no longer cause fouling in the preheat, convection and radiant sections of a steam cracker and in the downstream heat exchange and/or separation equipment for a steam cracker, for example in transfer line exchangers (TLEs) which are used to rapidly cool the effluent from a steam cracker. When hydrocarbons condense, they may thermally decompose into a coke layer which may cause fouling. Such fouling is a major factor determining the run length of the cracker. Reducing the amount of fouling results in longer run times without maintenance shutdowns, and improved heat transfer in the exchangers.

The steam cracking may be performed in any known way. The hydrocarbon feed is typically preheated. The feed can be heated using heat exchangers, a furnace or any other combination of heat transfer and/or heating devices. The feed is steam cracked in a cracking zone under cracking conditions to produce at least olefins (including ethylene) and hydrogen. The cracking zone may comprise any cracking system known in the art that is suitable for cracking the feed. The cracking zone may comprise one or more furnaces, each dedicated for a specific feed or fraction of the feed.

The cracking is performed at elevated temperatures, preferably in the range of from 650 to 1000° C., more preferably of from 700 to 900° C., most preferably of from 750 to 850° C. Steam is usually added to the cracking zone, acting as a diluent to reduce the hydrocarbon partial pressure and thereby enhance the olefin yield. Steam also reduces the formation and deposition of carbonaceous material or coke in the cracking zone. The cracking occurs in the absence of oxygen. The residence time at the cracking conditions is very short, typically in the order of milliseconds.

From the cracker, a cracker effluent is obtained that may comprise aromatics (as produced in the steam cracking process), olefins, hydrogen, water, carbon dioxide and other hydrocarbon compounds. The specific products obtained depend on the composition of the feed, the hydrocarbon-to-steam ratio, and the cracking temperature and furnace residence time. The cracked products from the steam cracker are then passed through one or more heat exchangers, often referred to as TLEs ("transfer line exchangers"), to rapidly reduce the temperature of the cracked products. The TLEs preferably cool the cracked products to a temperature in the range of from 400 to 550° C.

FIGURES

Figure 2:
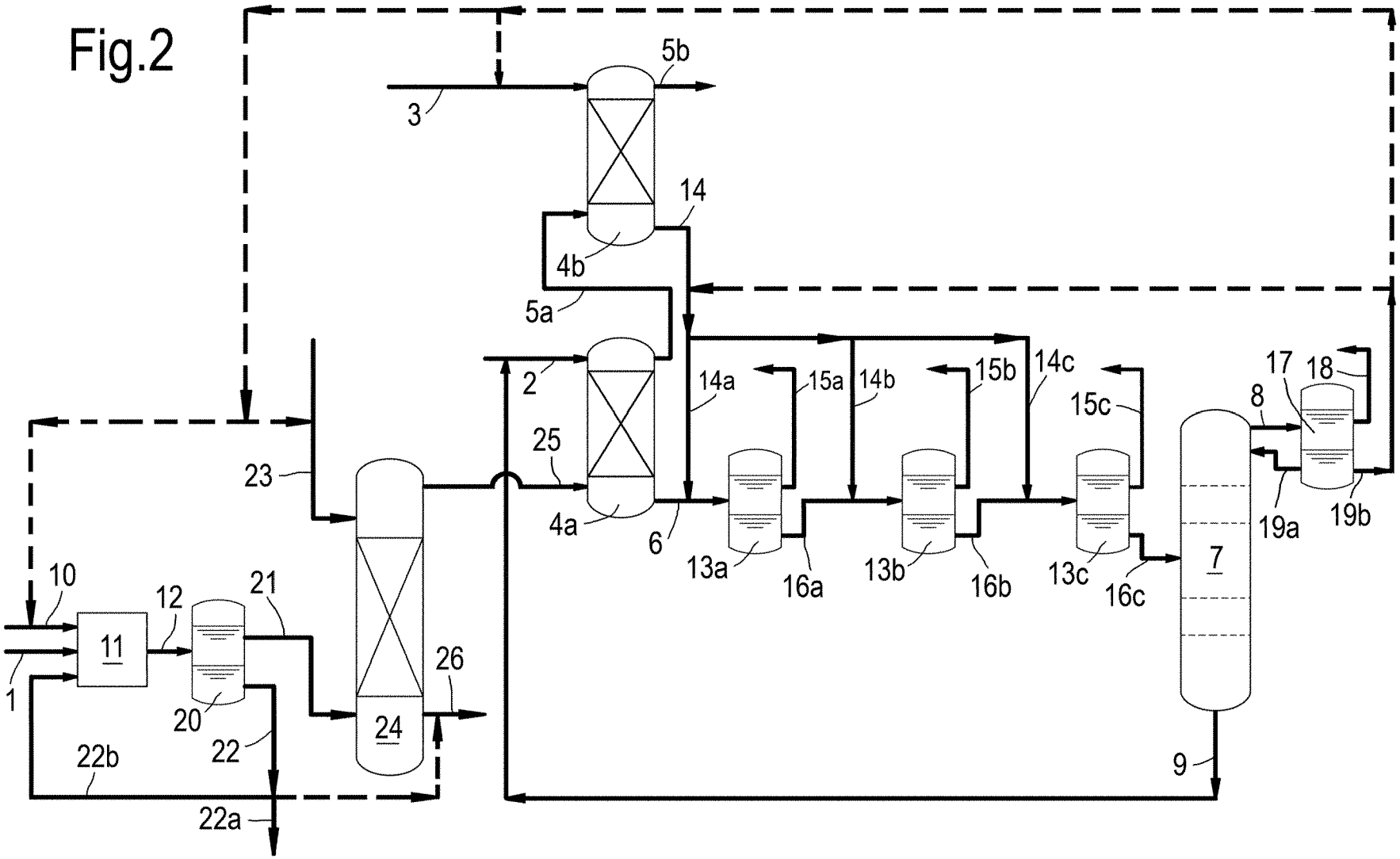
FIG. 2 shows another embodiment of the above-mentioned process.

The present process for the recovery of aliphatic hydrocarbons from a liquid hydrocarbon feedstock stream is further illustrated by FIGS. 1 and 2.

In the process of FIG. 1, a liquid hydrocarbon feedstock stream 1, which comprises aliphatic hydrocarbons (including conjugated aliphatic compounds having two or more carbon-carbon double bonds, which are hereinafter referred to as "dienes"), aromatic hydrocarbons, heteroatom containing organic compounds and salts, and a stream 10 which comprises water which is a washing solvent d) in accordance with the present invention and which has a pH of from 8 up to greater than 14 (caustic), are fed to and mixed in mixer 11. The resulting mixed stream 12 is fed to a decanter 20. In decanter 20, the mixed stream is separated into a stream 21 comprising aliphatic hydrocarbons, dienes, aromatic hydrocarbons and heteroatom containing organic compounds and a stream 22 comprising water, heteroatom containing compounds and salts. Stream 22 is split into streams 22*a* and 22*b*, wherein stream 22*b* is recycled to mixer 11 optionally after removing organic compounds and salts from stream 22*b*. Stream 21 and a stream 23 which comprises water, which is a washing solvent d) in accordance with the present invention and which has a pH of from 6 to 8 (e.g. about 7), are fed to an extraction column 24. In column 24, stream 21 is contacted with stream 23 (water), resulting in liquid-liquid extraction of heteroatom containing organic compounds with the water, resulting in a top stream 25 comprising aliphatic hydrocarbons, dienes, aromatic hydrocarbons and heteroatom containing organic compounds and a bottom stream 26 comprising water and heteroatom containing compounds. Stream 26 may be combined with part of stream 22 from decanter 20.

Further, in the process of FIG. 1, stream 25 from extraction column 24; a first solvent stream 2 which comprises an organic solvent (for example N-methylpyrrolidone) which is an extraction solvent a) in accordance with the present invention; and a second solvent stream 3 which comprises water which is an optional washing solvent c) in accordance with the present invention, are fed to an extraction column 4. In column 4, stream 25 is contacted with first solvent stream 2 (organic solvent), thereby recovering aliphatic hydrocarbons by liquid-liquid extraction of dienes, aromatic hydrocarbons and heteroatom containing organic compounds with the organic solvent. Further, the water in second solvent stream 3 removes organic solvent from the upper part of column 4 by liquid-liquid extraction of organic solvent with water. A stream 5 comprising recovered aliphatic hydrocarbons exits column 4 at the top. Further, a stream 6 comprising organic solvent, water, aliphatic hydrocarbons, dienes, aromatic hydrocarbons and heteroatom containing organic compounds exits column 4 at the bottom.

Further, in the process of FIG. 1, stream 6 and a stream 14*a* comprising additional water are combined, and the combined stream is fed to a first decanter 13*a*. Said water stream 14*a* and below water streams 14*b* and 14*c* are sub-streams split from a water stream 14, wherein the water in said sub-streams is a demixing solvent b) in accordance with the present invention. In decanter 13*a*, the combined stream is separated into a stream 15*a* comprising aliphatic hydrocarbons and a stream 16*a* comprising organic solvent, water, aliphatic hydrocarbons, dienes, aromatic hydrocarbons and heteroatom containing organic compounds. Then stream 16*a* and a stream 14*b* comprising additional water are combined, and the combined stream is fed to a second decanter 13*b*. In decanter 13*b*, the combined stream is separated into a stream 15*b* comprising aliphatic hydrocarbons, dienes, aromatic hydrocarbons and heteroatom containing organic compounds and a stream 16*b* comprising organic solvent, water, dienes, aromatic hydrocarbons and heteroatom containing organic compounds. Finally, stream 16*b* and a stream 14*c* comprising additional water are combined, and the combined stream is fed to a third decanter 13*c*. In decanter 13*c*, the combined stream is separated into a stream 15*c* comprising dienes, aromatic hydrocarbons and heteroatom containing organic compounds and a stream 16*c* comprising organic solvent, water and a reduced amount of dienes, aromatic hydrocarbons and heteroatom containing organic compounds.

Still further, in the process of FIG. 1, stream 16*c* is fed to a distillation column 7, where it is separated into a top stream 8 comprising water, dienes, aromatic hydrocarbons and heteroatom containing organic compounds and a bottom stream 9 comprising organic solvent. Organic solvent from bottom stream 9 is recycled via organic solvent stream 2. Stream 8 is fed to an overhead decanter 17, wherein it is separated into a stream 18 comprising dienes, aromatic hydrocarbons and heteroatom containing organic compounds and a stream comprising water, which may additionally comprise a relatively low amount of dienes, aromatic hydrocarbons and heteroatom containing organic compounds, part of which water stream (stream 19*a*) is sent back to distillation column 7 as a reflux stream whereas the other part (stream 19*b*) may be recycled via water stream 14 and/or water stream 3 and/or water stream 10 and/or water stream 23.

In the process of FIG. 2, the above-mentioned liquid hydrocarbon feedstock stream 1 is also first contacted with water, which is a washing solvent d) in accordance with the present invention, first in a mixer 11 and a decanter 20 and subsequently in an extraction column 24. In respect of such upstream treatments of said feedstock stream in the process of FIG. 2 reference is made to the above description of the corresponding treatments in the process of FIG. 1.

Further, in the process of FIG. 2, stream 25 from extraction column 24 which comprises aliphatic hydrocarbons, dienes, aromatic hydrocarbons and heteroatom containing organic compounds; and a first solvent stream 2 which comprises an organic solvent (for example N-methylpyrrolidone) which is an extraction solvent a) in accordance with the present invention, are fed to a first extraction column 4*a*. In column 4*a*, stream 25 is contacted with first solvent stream 2 (organic solvent), thereby recovering aliphatic hydrocarbons by liquid-liquid extraction of dienes, aromatic hydrocarbons and heteroatom containing organic compounds with the organic solvent, resulting in a top stream 5*a* comprising recovered aliphatic hydrocarbons and organic solvent and a bottom stream 6 comprising organic solvent, dienes, aromatic hydrocarbons and heteroatom containing organic compounds. Stream 5*a* and a second solvent stream 3 which comprises water, which is an optional washing solvent c) in accordance with the present invention, are fed to a second extraction column 4*b*. In column 4*b*, stream 5*a* is contacted with second solvent stream 3 (water), thereby removing organic solvent by liquid-liquid extraction of organic solvent with water. A stream 5*b* comprising recovered aliphatic hydrocarbons exits column 4*b* at the top. Further, a stream 14 comprising organic solvent and water exits column 4*b* at the bottom, and is split into sub-streams 14*a*, 14*b* and 14*c*, wherein the water in said sub-streams is a demixing solvent b) in accordance with the present invention. Streams 6 and 14*a* are combined, and the combined stream is fed to a first decanter 13*a*. In respect of the treatment in decanter 13*a* and further, downstream treatments in the process of FIG. 2 reference is made to the above description of the corresponding treatments in the process of FIG. 1. Optionally (not shown in FIG. 2), an additional sub-stream 14*d* may be split from stream 14 and fed directly to distillation column 7.

We claim:

1. A process for the recovery of aliphatic hydrocarbons from a liquid hydrocarbon feedstock stream comprising aliphatic hydrocarbons, heteroatom containing organic compounds and optionally aromatic hydrocarbons, wherein the liquid hydrocarbon feedstock stream comprises at least part of a hydrocarbon product formed in a process comprising cracking of waste plastics, said process comprising the steps of:

a) contacting at least part of the liquid hydrocarbon feedstock stream with an extraction solvent a) which contains one or more heteroatoms, and subjecting the liquid hydrocarbon feedstock stream to liquid-liquid extraction with the extraction solvent a), resulting in a first stream comprising aliphatic hydrocarbons and a second stream comprising extraction solvent a), aliphatic hydrocarbons, heteroatom containing organic compounds and optionally aromatic hydrocarbons;

b1) mixing at least part of the second stream resulting from step a) with a demixing solvent b) which contains one or more heteroatoms and has a miscibility in heptane which is lower than the miscibility of extraction solvent a) in heptane, and separating the resulting mixture into a first stream comprising aliphatic hydrocarbons and optionally aromatic hydrocarbons and a second stream comprising extraction solvent a), demixing solvent b), heteroatom containing organic compounds and optionally aromatic hydrocarbons;

b2) mixing at least part of the second stream resulting from step b1) with demixing solvent b) and separating the resulting mixture into a first stream comprising heteroatom containing organic compounds and optionally aromatic hydrocarbons and a second stream comprising extraction solvent a) and demixing solvent b);

wherein steps b1) and b2) are sub-steps of a step b) which comprises two or more sub-steps;

c) separating at least part of the second stream resulting from step b2) into a first stream comprising demixing solvent b) and a second stream comprising extraction solvent a);

d) recycling at least part of the extraction solvent a) from the second stream resulting from step c) to step a); and e) optionally recycling at least part of the demixing solvent b) from the first stream resulting from step c) to one or more of the sub-steps of step b), wherein:

(i) before step a), heteroatom containing organic compounds are removed from the liquid hydrocarbon feedstock stream by contacting at least part of that stream with a washing solvent d) which contains one or more heteroatoms and has a miscibility in heptane which is lower than the miscibility of extraction solvent a) in heptane.

2. The process according to claim 1, wherein step b) comprises of from 2 to 10 sub-steps.

3. The process according to claim 1, wherein step b) comprises:

bi) mixing at least part of the second stream resulting from step a) with demixing solvent b) and separating the resulting mixture into a first stream comprising aliphatic hydrocarbons and optionally aromatic hydrocarbons and a second stream comprising extraction solvent a), demixing solvent b), aliphatic hydrocarbons, heteroatom containing organic compounds and optionally aromatic hydrocarbons;

bii) mixing at least part of the second stream resulting from step bi) with demixing solvent b) and separating the resulting mixture into a first stream comprising aliphatic hydrocarbons, heteroatom containing organic compounds and optionally aromatic hydrocarbons and a second stream comprising extraction solvent a), demixing solvent b), heteroatom containing organic compounds and optionally aromatic hydrocarbons; and biii) mixing at least part of the second stream resulting from step bii) with demixing solvent b) and separating the resulting mixture into a first stream comprising heteroatom containing organic compounds and optionally aromatic hydrocarbons and a second stream comprising extraction solvent a) and demixing solvent b); and wherein step c) comprises separating at least part of the second stream resulting from step biii) into a first stream comprising demixing solvent b) and a second stream comprising extraction solvent a).

4. The process according to claim 1, wherein:

the washing solvent d) has a $R_{a,heptane}$ of at least 10 $MPa^{1/2}$, wherein $R_{a,heptane}$ refers to the Hansen solubility parameter distance with respect to heptane as determined at 25° C.; and the washing solvent d) has a solubility of sodium chloride, in g of NaCl per 100 g of solvent as determined at 25° C., of at least 0.1 g/100 g.

5. The process according to claim 1, wherein the washing solvent d) comprises one or more solvents selected from the group consisting of water, ammonia diols and triols, including monoethylene glycol (MEG), monopropylene glycol (MPG) and glycerol; glycol ethers, including oligoethylene glycols, including diethylene glycol, triethylene glycol and tetraethylene glycol; amides, including formamide and monoalkyl formamides and acetamides, wherein the alkyl group comprises 1 to 8 carbon atoms, including methyl formamide; dialkylsulfoxide, wherein the alkyl group comprises 1 to 8 carbon atoms, including dimethylsulfoxide (DMSO); sulfones, including sulfolane; hydroxy esters, including lactates, including methyl and ethyl lactate; aminic compounds, including ethylenediamine, monoethanolamine, diethanolamine and triethanolamine; carbonate compounds, including propylene carbonate and glycerol carbonate; and cycloalkanone compounds, including dihydrolevoglucosenone.

6. The process according to claim 1, wherein:

the extraction solvent a) has a $R_{a,heptane}$ of at least 5 $MPa^{1/2}$ and the demixing solvent b) has a $R_{a,heptane}$ of at least 20 $MPa^{1/2}$ wherein $R_{a,heptane}$ refers to the Hansen solubility parameter distance with respect to heptane as determined at 25° C.; and the $R_{a,heptane}$ for the demixing solvent b) is greater than the $R_{a,heptane}$ for extraction solvent a), wherein said difference in $R_{a,heptane}$ for solvents a) and b) is at least 1 $MPa^{1/2}$.

7. The process according to claim 1, wherein the extraction solvent a) comprises one or more solvents selected from the group consisting of ammonia diols and triols, including monoethylene glycol (MEG), monopropylene glycol (MPG), any isomer of butanediol and glycerol; glycol ethers, including oligoethylene glycols, including diethylene glycol, triethylene glycol and tetraethylene glycol, and monoalkyl ethers thereof, including diethylene glycol ethyl ether; amides, including N-alkylpyrrolidone, wherein the alkyl group comprises 1 to 8 carbon atoms, including N-methylpyrrolidone (NMP), formamide and di- and monoalkyl formamides and acetamides, wherein the alkyl group comprises 1 to 8 carbon atoms, including dimethyl formamide (DMF), methyl formamide and dimethyl acetamide; dialkylsulfoxide, wherein the alkyl group comprises 1 to 8 carbon atoms, including dimethylsulfoxide (DMSO); sulfones, including sulfolane; N-formyl morpholine (NFM); furan ring containing components and derivatives thereof, including furfural, 2-methyl-furan, furfuryl alcohol and tetrahydrofurfuryl alcohol; hydroxy esters, including lactates, including methyl and ethyl lactate; trialkyl phosphates, including triethyl phosphate; phenolic compounds, including phenol and guaiacol; benzyl alcoholic compounds, including benzyl alcohol; aminic compounds, including ethylenediamine, monoethanolamine, diethanolamine and triethanolamine; nitrile compounds, including acetonitrile and propionitrile trioxane compounds, including 1,3,5-trioxane; carbonate compounds, including propylene carbonate and glycerol carbonate; and cycloalkanone compounds, including dihydrolevoglucosenone.

8. The process according to claim 1, wherein the demixing solvent b) comprises one or more solvents selected from the group consisting of water, diols and triols, including monoethylene glycol (MEG), monopropylene glycol (MPG), any isomer of butanediol and glycerol; glycerol ethers, including oligoethylene glycols, including diethylene glycol, triethylene glycol and tetraethylene glycol, and monoalkyl ethers thereof, including diethylene glycol ethyl ether, amides, including N-alkylpyrrolidone, wherein the alkyl group comprises 1 to 8 carbon atoms, including N-methylpyrrolidone (NMP), formamide and di- and monoalkyl formamides and acetamides, wherein the alkyl group comprises 1 to 8 carbon atoms, including dimethyl formamide (DMF), methyl formamide and dimethyl acetamide; dialkylsulfoxide, wherein the alkyl group comprises 1 to 8 carbon atoms, including dimethylsulfoxide (DMSO); sulfones, including sulfolane N-formyl morpholine NFM); furan ring containing components and derivatives thereof, including furfural, 2-methyl-furan, furfuryl alcohol and tetrahydrofurfuryl alcohol; hydroxy esters, including lactates, including methyl and ethyl lactate; trialkyl phosphates, including triethyl phosphate; phenolic compounds, including phenol and guaiacol; benzyl alcoholic compounds, including benzyl alcohol; aminic compounds, including ethylenediamine, monoethanolamine, diethanolamine and triethanolamine nitrile compounds, including acetonitrile and propionitrile, trioxane compounds, including 1,3,5-trioxane; carbonate compounds, including propylene carbonate and glycerol carbonate; and cycloalkanone compounds, including dihydroleyoglucosenon.

9. The process according to claim 1, wherein:

a washing solvent c) is added to step a) resulting in a first stream comprising aliphatic hydrocarbons and a second stream comprising washing solvent c), extraction solvent a), heteroatom containing organic compounds and optionally aromatic hydrocarbons; or the first stream resulting from step a) comprises aliphatic hydrocarbons and extraction solvent a), at least part of which first stream is contacted with a washing solvent c) and is subjected to liquid-liquid extraction with the washing solvent c), resulting in a first stream comprising aliphatic hydrocarbons and a second stream comprising washing solvent c) and extraction solvent a).

10. The process according to claim 9, wherein the washing solvent c) is identical to or different from demixing solvent b).

11. A process for the recovery of aliphatic hydrocarbons from plastics, wherein at least part of the plastics comprises heteroatom containing organic compounds, said process comprising the steps of:

(I) cracking the plastics and recovering a hydrocarbon product comprising aliphatic hydrocarbons, heteroatom containing organic compounds and optionally aromatic hydrocarbons; and (II) subjecting a liquid hydrocarbon feedstock stream, which comprises at least part of the hydrocarbon product obtained in step (I), to the process of claim 1.

12. Process for steam cracking a hydrocarbon feed, comprising the steps of recovering aliphatic hydrocarbons from a liquid hydrocarbon feedstock stream in a process according to claim 1; and steam cracking a hydrocarbon feed which comprises aliphatic hydrocarbons as recovered in the preceding step.

* * * * *